US010641282B2

(12) United States Patent
Hayamitsu et al.

(10) Patent No.: US 10,641,282 B2
(45) Date of Patent: May 5, 2020

(54) FAN DEVICE AND VACUUM CLEANER INCLUDING THE SAME

(71) Applicant: Nidec Corporation, Kyoto (JP)

(72) Inventors: Ryosuke Hayamitsu, Kyoto (JP); Hitoshi Takaki, Kyoto (JP); Tatsuya Tatara, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 171 days.

(21) Appl. No.: 15/835,494

(22) Filed: Dec. 8, 2017

(65) Prior Publication Data

US 2018/0180058 A1 Jun. 28, 2018

(30) Foreign Application Priority Data

Dec. 28, 2016 (JP) ..... 2016-254620
Nov. 28, 2017 (JP) ..... 2017-227730

(51) Int. Cl.
*F04D 17/06* (2006.01)
*F04D 29/38* (2006.01)
(Continued)

(52) U.S. Cl.
CPC ..... *F04D 29/384* (2013.01); *A47L 5/28* (2013.01); *A47L 9/149* (2013.01); *A47L 9/2857* (2013.01);
(Continued)

(58) Field of Classification Search
CPC ..... F04D 29/384; F04D 17/06; F04D 25/06; F04D 25/082; F04D 29/165;
(Continued)

(56) References Cited

U.S. PATENT DOCUMENTS 1,338,466 A * 4/1920 Spencer ..... F04D 17/164 415/199.2
3,961,867 A * 6/1976 Woollenweber ..... F01D 5/025 417/407
(Continued)

FOREIGN PATENT DOCUMENTS

DE 25 35 878 A1 2/1977
EP 2 677 174 A2 12/2013
(Continued)

OTHER PUBLICATIONS

JP2005307985A—Machine Translation (Year: 2005).*

*Primary Examiner* — Woody A Lee, Jr.
*Assistant Examiner* — Brian Christopher Delrue
(74) *Attorney, Agent, or Firm* — Keating & Bennett

(57) ABSTRACT

A fan device includes an impeller rotating around a central axis and a motor disposed farther downward than the impeller. The impeller includes a base unit enlarged downward and plural blades disposed on a peripheral surface of the base unit. Upper portions of the blades are positioned at a leading end of a rotating direction with respect to lower portions. In an outer end portion on a front surface of each blade at the leading end of the rotating direction, a radial-direction component of a normal unit vector of an upper end portion of the blade is smaller than that of a lower end portion, assuming that an outer peripheral side of the blade is a positive direction. A thickness of a root of the lower end portion is larger than that of the upper end portion.

12 Claims, 17 Drawing Sheets

(51) Int. Cl.

| | |
|---|---|
| ***A47L 5/28*** | (2006.01) |
| ***A47L 9/28*** | (2006.01) |
| ***F04D 25/06*** | (2006.01) |
| ***F04D 29/54*** | (2006.01) |
| ***F04D 25/08*** | (2006.01) |
| ***A47L 9/14*** | (2006.01) |
| ***F04D 29/30*** | (2006.01) |
| ***F04D 29/42*** | (2006.01) |
| ***F04D 29/16*** | (2006.01) |
| ***F04D 29/28*** | (2006.01) |
| ***F04D 29/44*** | (2006.01) |

(52) U.S. Cl.
CPC ..... *F04D 17/06* (2013.01); *F04D 25/06* (2013.01); *F04D 25/082* (2013.01); *F04D 29/165* (2013.01); *F04D 29/281* (2013.01); *F04D 29/30* (2013.01); *F04D 29/4253* (2013.01); *F04D 29/444* (2013.01); *F04D 29/544* (2013.01)

(58) Field of Classification Search
CPC .... F04D 29/281; F04D 29/30; F04D 29/4253; F04D 29/444; F04D 29/544; F04D 17/164; F04D 17/168; A47L 5/28; A47L 9/149; A47L 9/2857
USPC ..... 415/211
See application file for complete search history.

(56) References Cited

U.S. PATENT DOCUMENTS 4,484,860 A * 11/1984 Brenholt ..... F04D 29/281 416/179
5,022,823 A * 6/1991 Edelmayer ..... F01D 5/025 416/244 A
5,451,147 A * 9/1995 Sakagami ..... F04D 19/04 384/109
6,135,709 A * 10/2000 Stones ..... F04D 19/046 415/143
6,375,413 B1 * 4/2002 Stones ..... F04D 17/168 415/73
6,488,475 B2 * 12/2002 Murata ..... A47L 5/22 417/32
6,755,611 B1 * 6/2004 Kabasawa ..... F04D 17/168 415/90
8,721,287 B2 * 5/2014 Billotey ..... F01D 5/141 415/206
9,267,510 B2 * 2/2016 Tadokoro ..... F04D 29/30
2001/0055526 A1 * 12/2001 Kawasaki ..... F04D 17/168 415/90
2003/0185667 A1 * 10/2003 Englander ..... F04D 17/168 415/55.1
2004/0211318 A1 * 10/2004 Morgan ..... A47L 5/22 95/270
2005/0260070 A1 * 11/2005 Hsu ..... F04D 25/0606 415/199.6
2006/0275123 A1 * 12/2006 Hatsugai ..... F04D 29/281 416/189
2007/0059179 A1 * 3/2007 Xu ..... F04D 29/284 416/182
2008/0056886 A1 * 3/2008 Hablanian ..... F04D 17/168 415/90
2010/0329871 A1 * 12/2010 Cahill ..... F04D 29/023 416/187
2011/0173975 A1 * 7/2011 Sun ..... F02B 47/08 60/605.2
2011/0318183 A1 * 12/2011 Noronha ..... B23P 15/006 416/189
2012/0138058 A1 * 6/2012 Fu ..... A61M 16/0066 128/204.23
2012/0156026 A1 * 6/2012 Merritt ..... F04D 29/286 415/207
2012/0189454 A1 * 7/2012 Iwakiri ..... F04D 29/30 416/223 R
2012/0328444 A1 * 12/2012 Sugimoto ..... F04D 29/284 416/223 B
2014/0134020 A1 * 5/2014 Cho ..... F04D 17/16 417/420
2014/0328670 A1 * 11/2014 Lamb ..... F04D 29/668 415/119
2015/0125302 A1 * 5/2015 Roberto ..... F01D 5/141 416/183
2015/0337856 A1 * 11/2015 Hwang ..... F04D 29/441 415/174.3
2017/0051755 A1 * 2/2017 Liu ..... A47L 5/22
2017/0194833 A1 * 7/2017 Bang ..... H02K 7/003
2018/0156233 A1 * 6/2018 Sawada ..... F04D 29/44
2018/0163747 A1 * 6/2018 Hayamitsu ..... F04D 25/0606
2018/0180058 A1 * 6/2018 Hayamitsu ..... F04D 17/06
2018/0263446 A1 * 9/2018 Hayamitsu ..... H02K 11/33
2018/0266438 A1 * 9/2018 Hayamitsu ..... H02K 7/14
2019/0010954 A1 * 1/2019 Takao ..... F04D 17/165
2019/0113046 A1 * 4/2019 Palmer-White ..... F04D 29/30

FOREIGN PATENT DOCUMENTS

JP 01267390 A * 10/1989 ..... F04D 17/168
JP 02070929 A * 3/1990 ..... F01D 9/042
JP 02264196 A * 10/1990 ..... F04D 17/168
JP 04136497 A * 5/1992 ..... F04D 19/04
JP 05087093 A * 4/1993 ..... F04D 29/281
JP 2005-307985 A 11/2005
JP 2005307985 A * 11/2005
JP 2010-281232 A 12/2010

* cited by examiner

FAN DEVICE AND VACUUM CLEANER INCLUDING THE SAME

CROSS REFERENCE TO RELATED APPLICATIONS

This application claims the benefit of priority to Japanese Patent Application No. 2016-254620 filed on Dec. 28, 2016 and Japanese Patent Application No. 2017-227730 filed on Nov. 28, 2017. The entire contents of these applications are hereby incorporated herein by reference.

BACKGROUND OF THE INVENTION

1. Field of the Invention

The present disclosure relates to a fan device and a vacuum cleaner including the same.

2. Description of the Related Art

An example of known electric fan devices is disclosed in Japanese Unexamined Patent Application Publication No. 2010-281232. This electric fan device is installed in an electric vacuum cleaner. The electric fan device includes an impeller rotating around a central axis extending in the front-rear direction and an electric motor disposed at the rear of the impeller. The impeller includes a plurality of mixed-flow blades formed by three-dimensional curved surfaces. The impeller is housed within a fan case having an opened suction inlet on the front side. The thickness of a root of the rear end portion of the mixed-flow blade is substantially the same as that of the front end portion thereof. The outer edge of the rear end portion of the mixed-flow blade is projected closer to the trailing end of the rotating direction of the impeller than the root of the rear end portion.

The electric motor includes a cylindrical motor case. A rotor and a stator are housed within the motor case. The rotor is interconnected to a drive shaft of the impeller.

A cylindrical air guide extending rearward along the peripheral surface of the motor case is provided at the rear of the fan case. An air passage is formed in a gap between the air guide and the motor case. The air passage communicates with the impeller, and an evacuate outlet is formed at the rear end of the air passage. Guide blades integrally formed with the motor case are disposed within the air passage.

In the electric fan device configured as described above, when the rotor is rotated, air flows into the fan case via the suction inlet. The air then flows into between the adjacent mixed-flow blades and accelerates outward in the radial direction along the mixed-flow blades. The air is then blown out to the rearward direction at the radial-direction outer side of the impeller. Then, the air flows through the air passage and is then evacuated to the outside via the evacuate outlet.

SUMMARY OF THE INVENTION

Typically, a mixed-flow blade is formed by removing a mold placed between the adjacent mixed-flow blades rearward and outward in the radial direction. In the electric fan device disclosed in the above-described publication, the outer edge of the rear end portion of the mixed-flow blade is projected closer to the trailing end of the rotating direction of the impeller than the root of the rear end portion. Because of this configuration, when the mold is removed, it interferes with the outer edge of the rear end portion of the mixed-flow blade so as to damage the mixed-flow blade. This results in poor mass productivity of electric fan devices.

According to a preferred embodiment of the present disclosure, there is provided a fan device including an impeller and a motor. The impeller rotates around a central axis extending in a top-bottom direction. The motor is disposed farther downward than the impeller and rotates the impeller. The impeller includes a base unit and a plurality of blades. The base unit is enlarged toward a downward direction. The plurality of blades are disposed on a peripheral surface of the base unit. Upper portions of the blades are positioned at a leading end of a rotating direction with respect to lower portions of the blades. In an outer end portion on a front surface of each of the blades which is positioned at the leading end of the rotating direction, a radial-direction component of a normal unit vector of an upper end portion of the blade is smaller than a radial-direction component of a normal unit vector of a lower end portion of the blade, assuming that an outer peripheral side of the blade is a positive direction. A thickness of a root of the lower end portion is larger than a thickness of a root of the upper end portion.

According to a preferred embodiment of the present disclosure, it is possible to provide a fan device with improved mass productivity and a vacuum cleaner including the same.

The above and other elements, features, steps, characteristics, and advantages of the present disclosure will become more apparent from the following detailed description of the preferred embodiments with reference to the attached drawings.

DETAILED DESCRIPTION OF THE PREFERRED EMBODIMENTS

A preferred embodiment of the present disclosure will be described below in detail with reference to the accompanying drawings. In this specification, with respect to a fan device 1, a direction parallel with a central axis C of the fan device 1 will be called "the axial direction", a direction perpendicular to the central axis C will be called "the radial direction", and the direction along an arc about the central axis C will be called "the circumferential direction". Likewise, with respect to an impeller 10 which is built in the fan device 1, directions which coincide with the axial direction, the radial direction, and the circumferential direction of the fan device 1 are also called "the axial direction", "the radial direction", and "the circumferential direction". In this specification, the configurations of the individual elements of the fan device 1 and the positional relationships thereof will be described, assuming that the axial direction is the top-bottom direction and that the side of a fan casing 2 closer to a suction inlet 3 is the upper side. The term "the top-bottom direction" is used only for description and will not restrict the directions and the actual positional relationships of the individual elements. "Upstream" and "downstream" indicate the upstream side and the downstream side in the flowing direction of air sucked from the suction inlet 3 when the impeller 10 is rotated.

Figure 1:
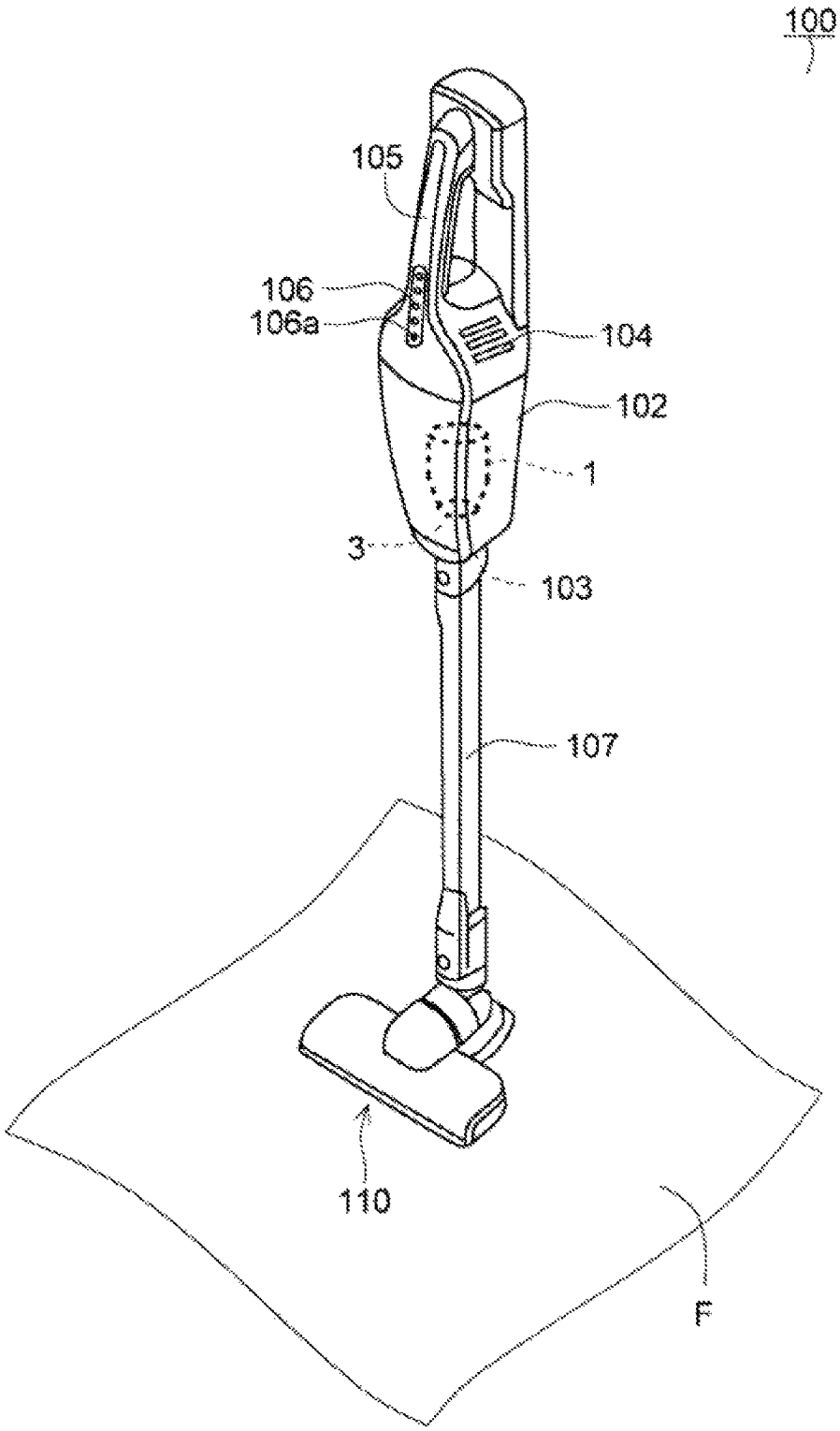
FIG. 1 is a perspective view of a vacuum cleaner including a fan device according to an embodiment.

In this specification, the configurations of the individual elements of a vacuum cleaner 100 and the positional relationships thereof will be described, assuming that the direction in which the vacuum cleaner 100 approaches a floor F (surface to be cleaned) shown in FIG. 1 is "upward" and the direction in which the vacuum cleaner 100 separates from the floor F is "downward". The upward and downward directions are used only for description and will not restrict the direction and the actual positional relationships of the individual elements. "Upstream" and "downstream" indicate the upstream side and the downstream side in the flowing direction of air sucked from the suction inlet 103 when the fan device 1 is driven.

A vacuum cleaner according to a preferred embodiment of the present disclosure will be described below. FIG. 1 is a perspective view of a vacuum cleaner 100 according to this embodiment. The vacuum cleaner 100, which is a so-called stick-type electric vacuum cleaner, includes a casing 102 having an opened suction inlet 103 on the bottom surface and an opened evacuate outlet 104 on the top surface. A power cord (not shown) extends from the back surface of the casing 102. The power cord is connected to an outlet (not shown) disposed on a side wall surface of a room and supplies power to the vacuum cleaner 100. The vacuum cleaner 100 may be a robot, canister, or hand-held electric vacuum cleaner.

Within the casing 102, an air passage (not shown) which interconnects the suction inlet 103 and the evacuate outlet 104 is formed. Within the air passage, a dust collector (not shown), a filter (not shown), and the fan device 1 are sequentially disposed from the upstream side to the downstream side. Trash such as dust included in air passing through the air passage is blocked by the filter and is collected in the dust collector formed in the shape of a container. The dust collector and the filter are detachably attached to the casing 102.

A handle 105 and an operation unit 106 are disposed on the upper side of the casing 102. A user can move the vacuum cleaner 100 by holding the handle 105. The operation unit 106 has plural buttons 106*a*. The user sets operation settings of the vacuum cleaner 100 by using the buttons 106*a*. For example, the user can provide instructions to start driving, to stop driving, and to change the motor speed of the fan device 1. A bar-shaped suction tube 107 is connected to the suction inlet 103. A suction nozzle 110 is detachably attached to the upstream end (lower end in FIG. 1) of the suction tube 107.

Figure 2:
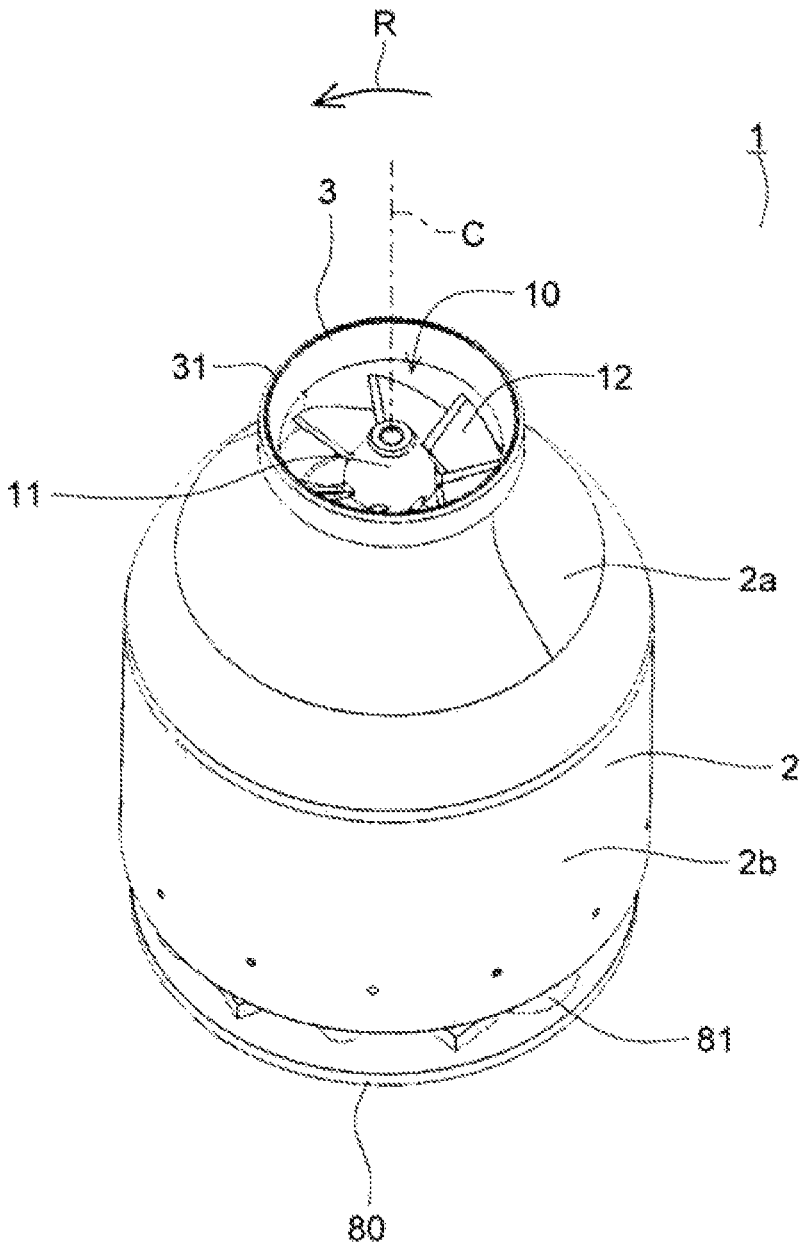
FIG. 2 is a perspective view of the fan device.
Figure 3:
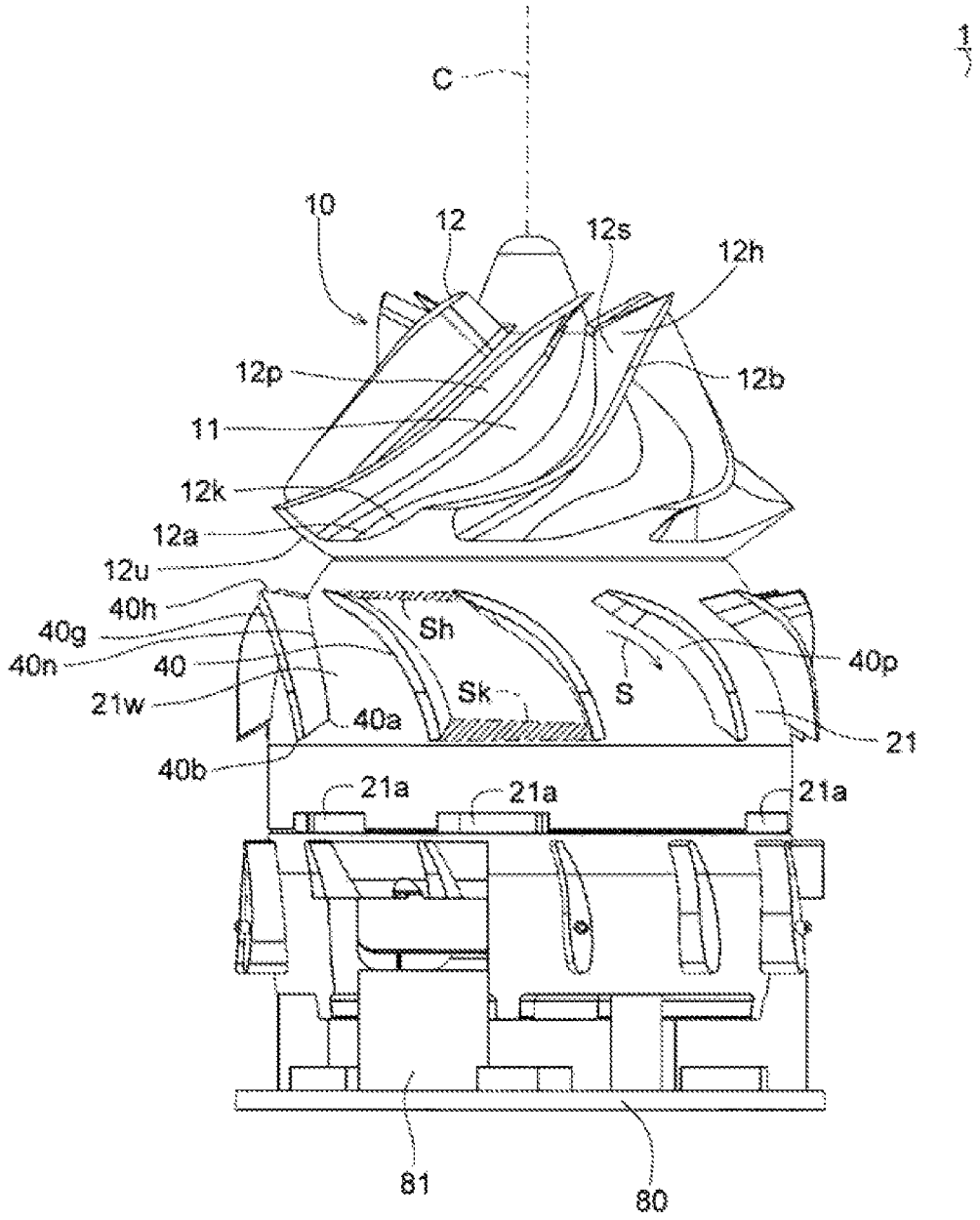
FIG. 3 is a front view of the internal configuration of the fan device.

FIG. 2 is a perspective view of the fan device 1 according to this embodiment. FIG. 3 is a front view of the internal configuration of the fan device 1. The fan device 1 is installed in the vacuum cleaner 100 and sucks air.

The fan device 1 includes a tubular fan casing 2 formed in the shape of a circle on a horizontal cross section. The fan casing 2 houses an impeller 10 and a motor housing 21. The fan casing 2 includes an upper case 2*a* which covers the impeller 10 and a lower case 2*b* which covers the motor housing 21.

The suction inlet 3, which is opened in the top-bottom direction (axial direction), is provided on the upper side of the fan casing 2 (on the upper case 2*a*). A bell mouth 31, which bends inward from the top end of the suction inlet 3 and extends downward, is provided in the suction inlet 3. With the formation of the bell mouth 31, the diameter of the suction inlet 3 smoothly decreases from the upward to downward direction. The upper side of the fan casing 2 covers the upper portion of the impeller 10. The bottom surface of the fan casing 2 is opened in the top-bottom direction.

The tubular motor housing 21, which is formed in the shape of a circle on a horizontal cross section, houses a motor 20 (see FIG. 3) interconnected to the impeller 10. The impeller 10 rotates around the central axis C extending in the top-bottom direction. The motor 20, which is disposed farther downward than the impeller 10, rotates the impeller 10. That is, the motor 20 is driven to rotate the impeller 10 around the central axis C in a rotating direction R shown in FIG. 2.

The upper case 2*a* and the lower case 2*b* of the fan casing 2 may be formed by a single member or by different members.

Figure 4:
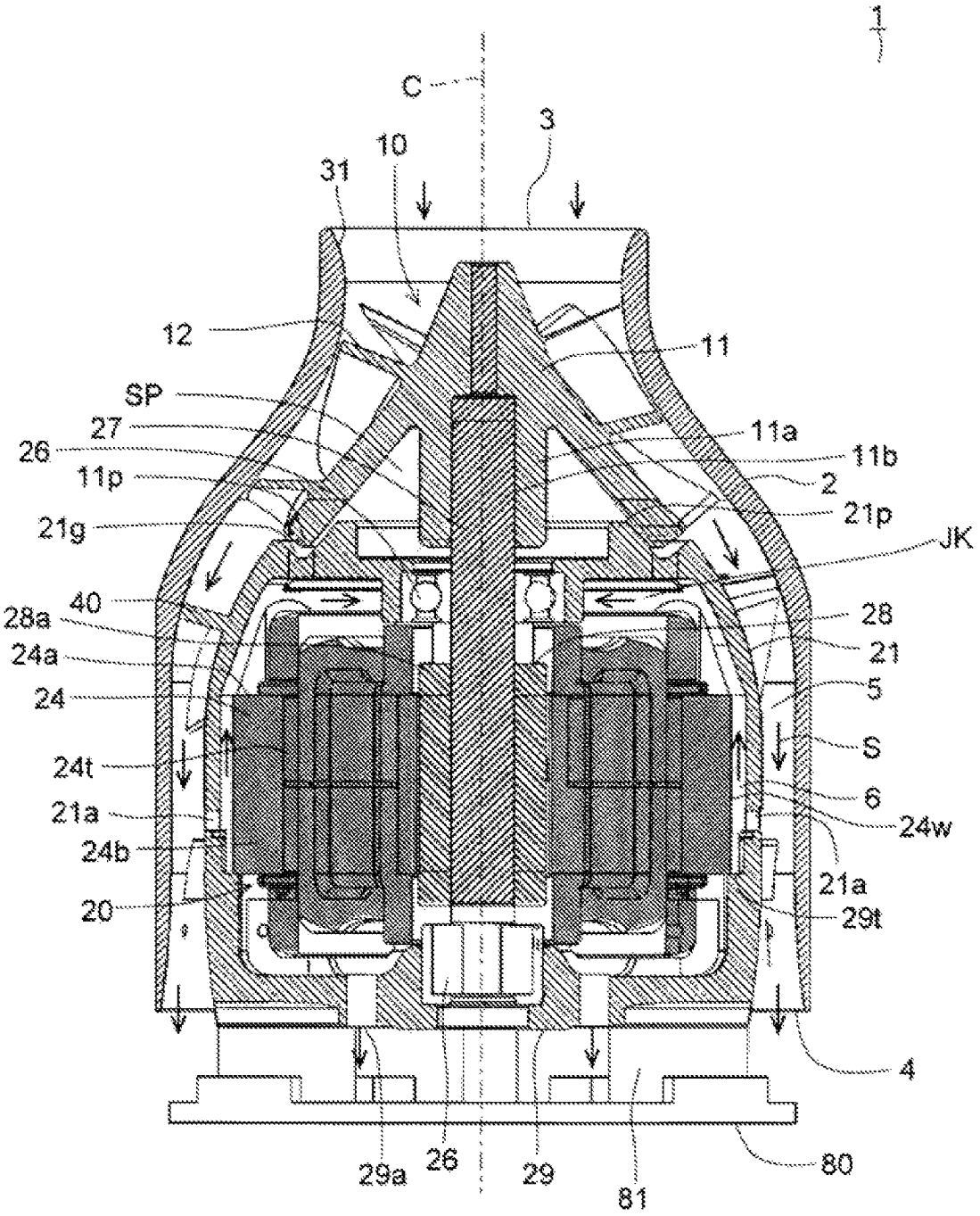
FIG. 4 is a side sectional view of the fan device.

FIG. 4 is a side sectional view of the fan device 1. A flow passage 5 (first flow passage) is formed in a gap between the fan casing 2 and the motor housing 21. The upper end (upstream end) of the flow passage 5 communicates with the impeller 10, and an evacuate outlet 4 is formed on the lower end (downstream end) of the flow passage 5.

A ring-like groove 21*g* denting downward is formed on the top surface of the motor housing 21. An impeller projection 11*p* projecting downward is formed on the bottom surface of a base unit 11 of the impeller 10. At least part of the impeller projection 11*p* is housed within the groove 21*g*.

Figure 5:
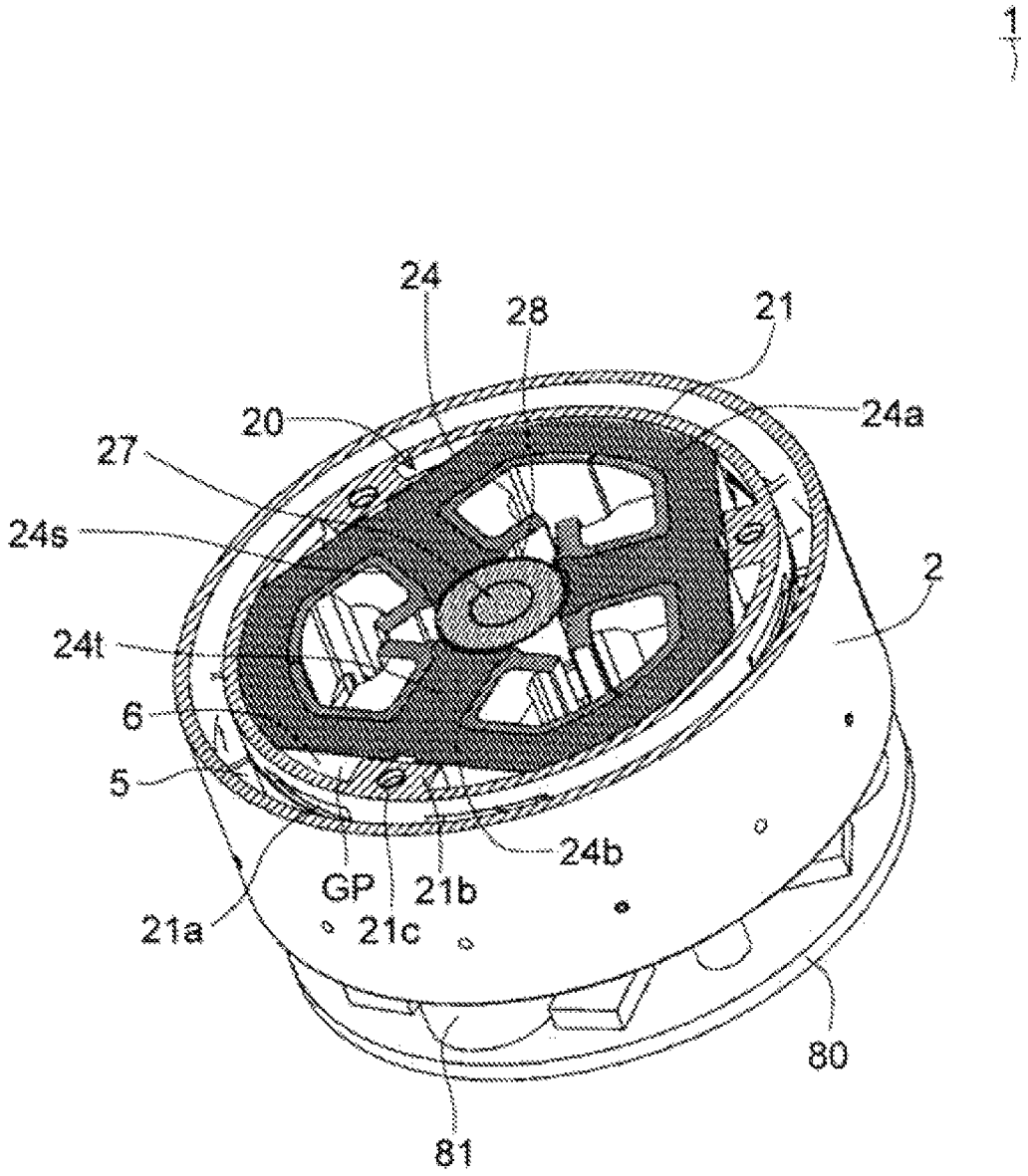
FIG. 5 is a perspective view of a horizontal cross section of the fan device as viewed from above, on a level higher than flow inlets of the fan device.
Figure 6:
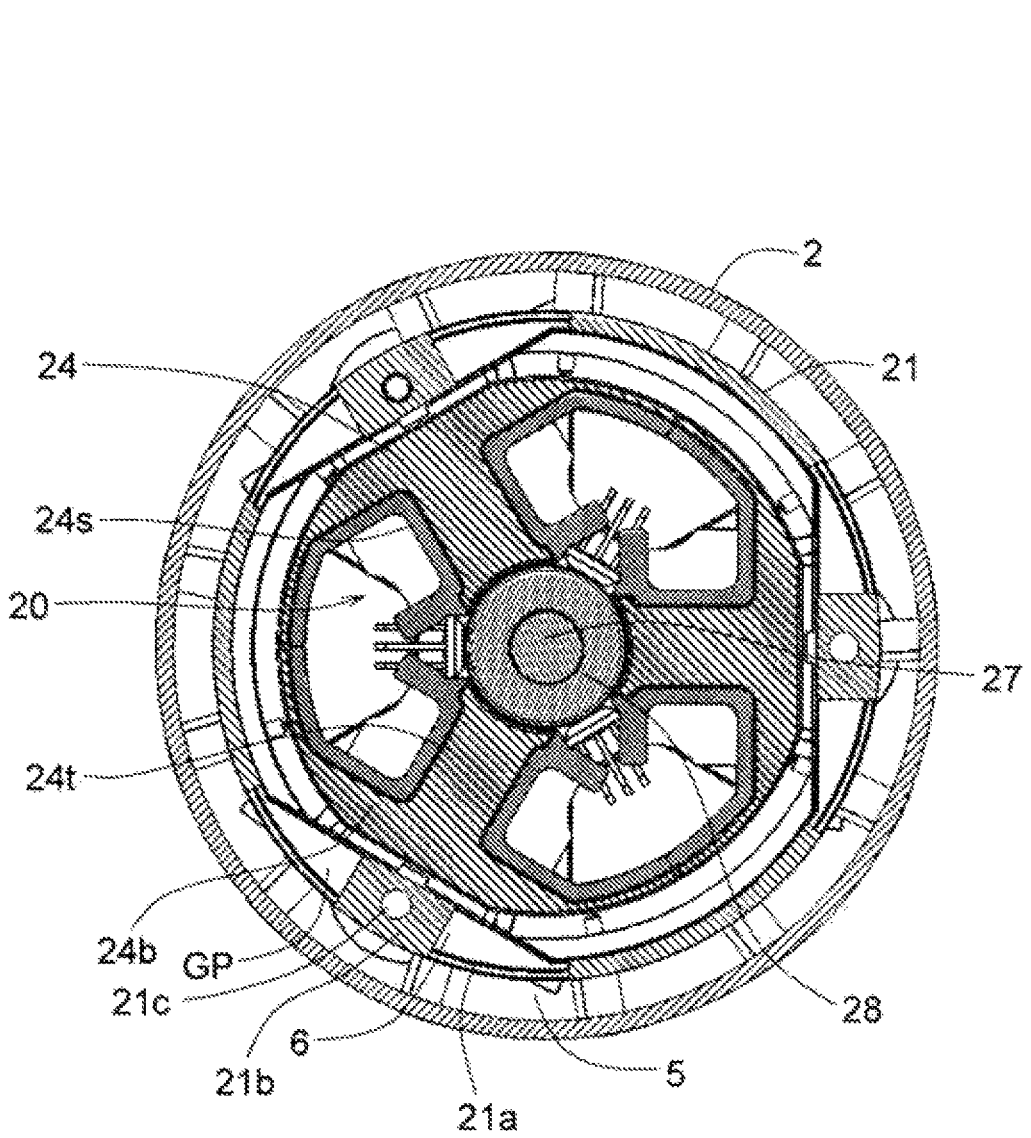
FIG. 6 is a plan sectional view of the fan device.

FIG. 5 is a perspective view of a horizontal cross section of the fan device 1 as viewed from above, on a level higher than flow inlets 21*a* of the fan device 1. FIG. 6 is a plan sectional view of a cross section passing through the flow inlets 21*a* of the fan device 1. As shown in FIG. 4, the motor 20 housed within the motor housing 21 is disposed farther downward than the impeller 10. The motor 20 is an inner rotor motor and includes a stator 24 and a rotor 28 which oppose each other.

The stator 24 is disposed farther outward than the rotor 28 in the radial direction. The stator 24 has a stator core 24*a* and plural coils (not shown). The stator core 24*a* is constituted by laminated steel sheets formed by overlaying electromagnetic steel sheets on each other in the axial direction (top-bottom direction in FIG. 4). The stator core 24*a* has a ring-like core back 24*b* and plural teeth 24*t*.

The plural teeth 24*t* are radially formed by extending from the inner peripheral surface of the core back 24*b* inward toward a magnet (not shown) of the rotor 28. The plural teeth 24*t* are circumferentially disposed. The plural coils are each formed by winding a conducting wire around a corresponding tooth 24*t* with an insulator 24*s* therebetween.

Portions of the inner and outer peripheral surfaces of the core back 24*b* near the tails of the teeth 24*t* are formed flat. It is thus possible to prevent collapsing of the coils, as well as to prevent the disturbance of magnetic field lines. The other portions of the inner and outer peripheral surfaces of the core back 24*b* are curved. With this configuration, a gap GP (see FIGS. 5 and 6) is formed between at least part of the core back 24*b* and the inner surface of the motor housing 21. More specifically, the gap GP is formed between the outer peripheral surface of a flat portion of the core back 24*b* and the inner surface of the motor housing 21.

A lead line (not shown) extends from each coil, and one end of the lead line is connected to a drive circuit (not shown) on a substrate 80 disposed farther downward than the fan casing 2. With this configuration, power is supplied to the coils. A capacitor 81 is mounted on the substrate 80.

A disk-like bottom lid 29 is disposed farther downward than the stator 24 and covers the bottom surface of the motor housing 21. A protruding portion 21*b* is formed on the inner surface of the motor housing 21. A ring-like step portion 29*t* is provided in the bottom lid 29 such that it opposes the bottom surface of the protruding portion 21*b*. By inserting a screw (not shown) passing through the step portion 29*t* into a screw hole 21*c* in the projection 29*b*, the bottom lid 29 is fixed to the motor housing 21. Plural flow outlets 29*a* passing through the bottom lid 29 in the axial direction are provided in the bottom lid 29.

The rotor 28 is disposed on farther inward than the stator 24 in the radial direction. The rotor 28 includes a cylindrical rotor housing 28*a* and plural magnets (not shown). The plural magnets are disposed on the outer peripheral surface of the rotor housing 28*a*. The radial-direction outer surface of each magnet opposes the radial-direction inner end surface of a corresponding tooth 24*t*. N-pole magnetic faces and S-pole magnetic faces of the plural magnets are alternately arranged and are equally spaced in the circumferential direction.

The plural magnets may be replaced by a single ring-like magnet. In this case, N poles and S poles are alternately magnetized on the inner peripheral surface of the magnet. A magnet or magnets and the rotor housing 28*a* may be integrally formed by a resin mixed with magnetic powders.

The rotor housing 28*a* holds a shaft 27 extending in the axial direction. The shaft 27 is supported by upper and lower bearings 26 and rotates around the central axis C in the rotating direction R together with the rotor 28. A boss 11*a* is formed on the bottom surface of the central portion of the base unit 11 of the impeller 10. The upper side of the shaft 27 is pressed into a hole 11*b* formed in the center of the boss 11*a* (formed on the central axis C).

The upper bearing 26 is disposed farther inward than the core back 24*b* in the radial direction, while the lower bearing 26 is disposed at the central portion of the bottom lid 29. The upper bearing 26 is constituted by a ball bearing, while the lower bearing 26 is constituted by a sliding bearing. The upper and lower bearings 26 may be constituted by other types of bearings.

The plural flow inlets 21*a* which communicate with the flow passage 5 are provided on the periphery of the wall of the motor housing 21. The flow inlets 21*a* pass through the motor housing 21 in the radial direction farther downward than the top surface of the stator 24 fixed to the inner surface of the motor housing 21. In this embodiment, the flow inlets 21*a* are disposed near the corresponding teeth 24*t*, and two flow inlets 21*a* are provided for one tooth 24*t*.

The motor housing 21 has a flow passage 6 (second flow passage) which extends from the flow inlets 21*a* and which communicates with a space JK farther upward than the stator 24. The flow passage 6 includes the gap GP between the core back 24*b* and the inner surface of the motor housing 21. An outer surface 24*w* (see FIG. 4) of the core back 24*b* forms a side surface of the flow passage 6. The lower end of the flow passage 6 is closed by the step portion 29*t* of the bottom lid 29. With this configuration, a stream S flowing into the flow passage 6 entirely flows upward.

The inner surface of the motor housing 21 positioned farther upward than the stator 24 tilts farther inward in the radial direction as it is directed farther upward.

The fan device 1 includes the impeller 10 which rotates around the central axis C extending in the top-bottom direction. The fan device 1 also includes the motor 20 which is disposed farther downward than the impeller 10 and which has the stator 24 to rotate the impeller 10. The fan device 1 also includes the motor housing 21 which houses the stator 24. The fan device 1 also includes the fan casing 2 which houses the impeller 10 and the motor housing 21 and which forms the flow passage 5 (first flow passage) in a gap between the fan casing 2 and the motor housing 21. The upper side of the fan casing 2 covers the upper portion of the impeller 10 and has the suction inlet 3 which is opened in the top-bottom direction. The lower side of the fan casing 2 has the evacuate outlet 4 which communicates with the suction inlet 3 via the flow passage 5. The flow inlets 21*a* are provided in the motor housing 21 farther downward than the top surface of the stator 24 fixed to the inner surface of the motor housing 21. The flow inlets 21*a* pass through the motor housing 21 in the radial direction so as to communicate with the flow passage 5. The motor housing 21 also has the flow passage 6 (second flow passage) which extends from the flow inlets 21*a* upward and communicates with the space JK formed farther upward than the stator 24.

Plural stationary blades 40 are provided on an outer peripheral surface 21*w* of the motor housing 21. The stationary blades 40 are formed in a sheet-like shape, and tilt upward in a direction opposite the rotating direction R of the impeller 10. The stationary blades 40 on the side closer to the impeller 10 are curved in a convex shape. The outer edges of the stationary blades 40 contact the inner surface of the fan casing 2. The stationary blades 40 are arranged side by side in the circumferential direction, and guide the stream S downward when the fan device 1 is driven. The flow inlets 21*a* are provided farther downward than the upper ends of the stationary blades 40.

An upper edge 40*h* (see FIG. 3) of a stationary blade 40 extends farther upward as it is directed farther outward in the radial direction. The length of an outer end portion 40*g* (see FIG. 3) of the stationary blade 40 in the top-bottom direction is longer than that of an inner end portion 40*n* (see FIG. 3) of the stationary blade 40. The outer end portion 40*g* is a portion extending in the top-bottom direction while being contact with the inner surface of the fan casing 2. The inner end portion 40*n* is a portion extending in the top-bottom direction farther inward than the outer end portion 40*g* in the radial direction while being contact with the outer peripheral surface 21*w* of the motor housing 21. An outer end 40*b* (see FIG. 3) of the lower edge of the stationary blade 40 is disposed farther downward than an inner end 40*a* (see FIG. 3). Although in this embodiment the stationary blades 40 and the fan casing 2 are formed by different members, they may be integrally formed by the same member. In this case, the top-bottom length of the stationary blade 40 positioned slightly farther inward than the inner surface of the fan casing 2 is set as the top-bottom length of the outer end portion 40*g* of the stationary blade 40.

The sectional area Sk (see FIG. 3) of the lower end of a flow passage between the stationary blades 40 which are adjacent to each other in the circumferential direction is larger than the sectional area Sh (see FIG. 3) of the upper end of the flow passage therebetween.

Figure 7:
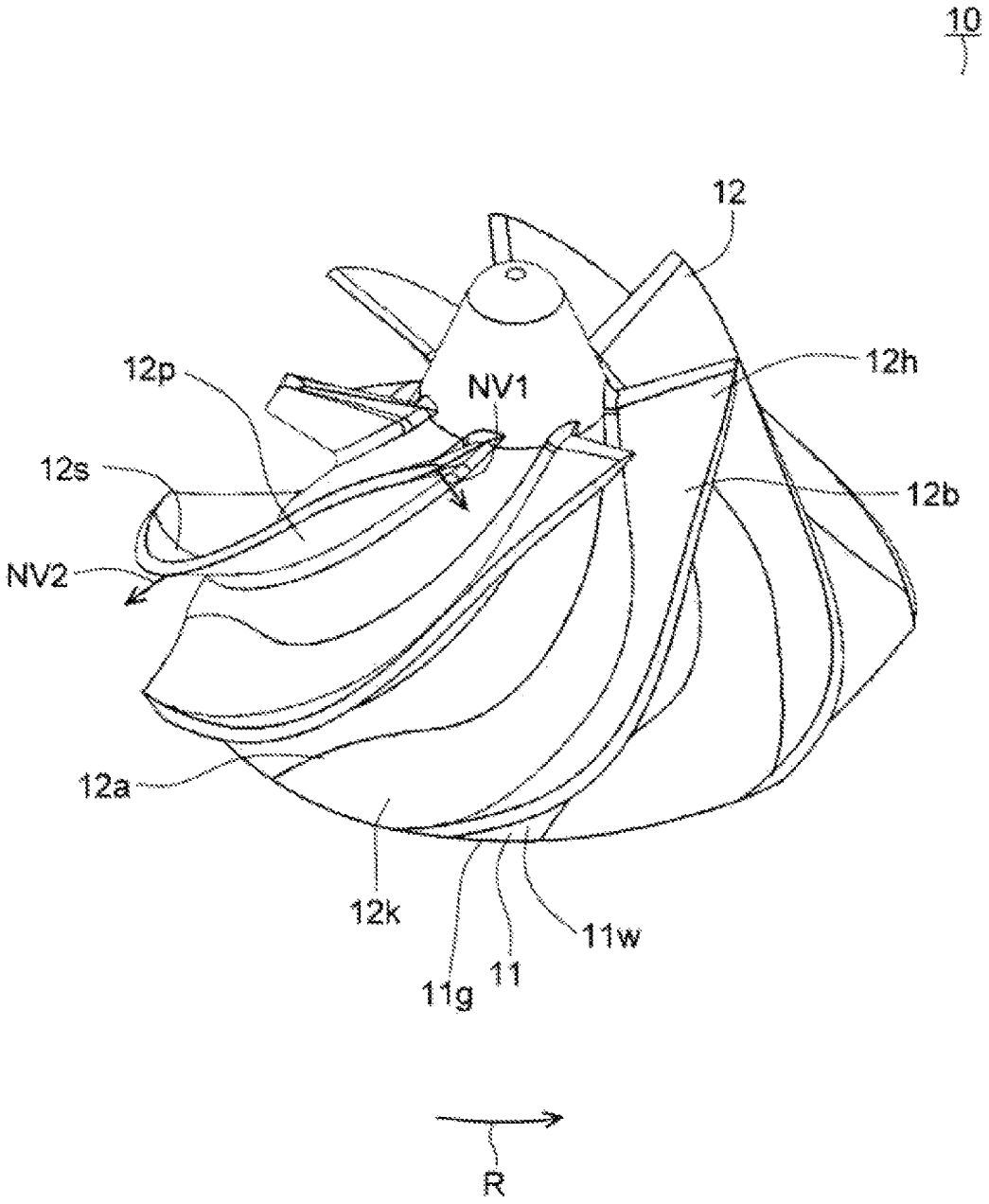
FIG. 7 is a perspective view of an impeller of the fan device.

FIG. 7 is a perspective view of the impeller 10. The impeller 10 is a so-called mixed-flow impeller formed by a resin molding. The impeller 10 includes a base unit 11 and plural blades 12. The diameter of the base unit 11 increases as it is directed farther downward. That is, the impeller 10 includes the base unit 11 which is enlarged toward a downward direction. As shown in FIG. 4, the upper end (leading end) of the base unit 11 is positioned at substantially the same level as the lower end of the bell mouth 31.

At the center of the boss 11*a* of the base unit 11 (on the central axis C), the hole 11*b* for receiving the shaft 27 of the motor 20 is formed. With this configuration, the boss 11*a* and the shaft 27 are interconnected to each other, and the impeller 10 rotates around the central axis C in the rotating direction R (see FIG. 2).

The plural blades 12 are arranged side by side on an outer peripheral surface 11*w* of the base unit 11 in the circumferential direction. In this embodiment, the blades 12 are arranged on the outer peripheral surface 11*w* of the base unit 11 at predetermined intervals and are integrally formed with the base unit 11. The upper portion of the blade 12 is positioned at the leading end of the rotating direction R with respect to the lower portion. An outer end portion 12*b* of the blade 12 is positioned at the leading end of the rotating direction R with respect to a root 12*a* of the blade 12. In the outer end portion 12*b* on a front surface 12*p* (pressure surface) positioned at the leading end of the rotating direction R, a radial-direction component of a normal unit vector NV1 of an upper end portion 12*h* is smaller than that of a normal unit vector NV2 of a lower end portion 12*k*, assuming that the outer peripheral side of the blade 12 is the positive direction.

In this embodiment, the radial-direction component of the normal unit vector NV1 is substantially 0, while the normal unit vector NV2 has a radial-direction component directed toward the outer peripheral side. The normal unit vector NV1 may have a radial-direction component directed toward the inner peripheral side. If the radial-direction component of the normal unit vector NV1 and that of the normal unit vector NV2 are directed toward the outer peripheral side, the absolute value of the radial-direction component of the normal unit vector NV1 is smaller than that of the normal unit vector NV2.

Figure 8:
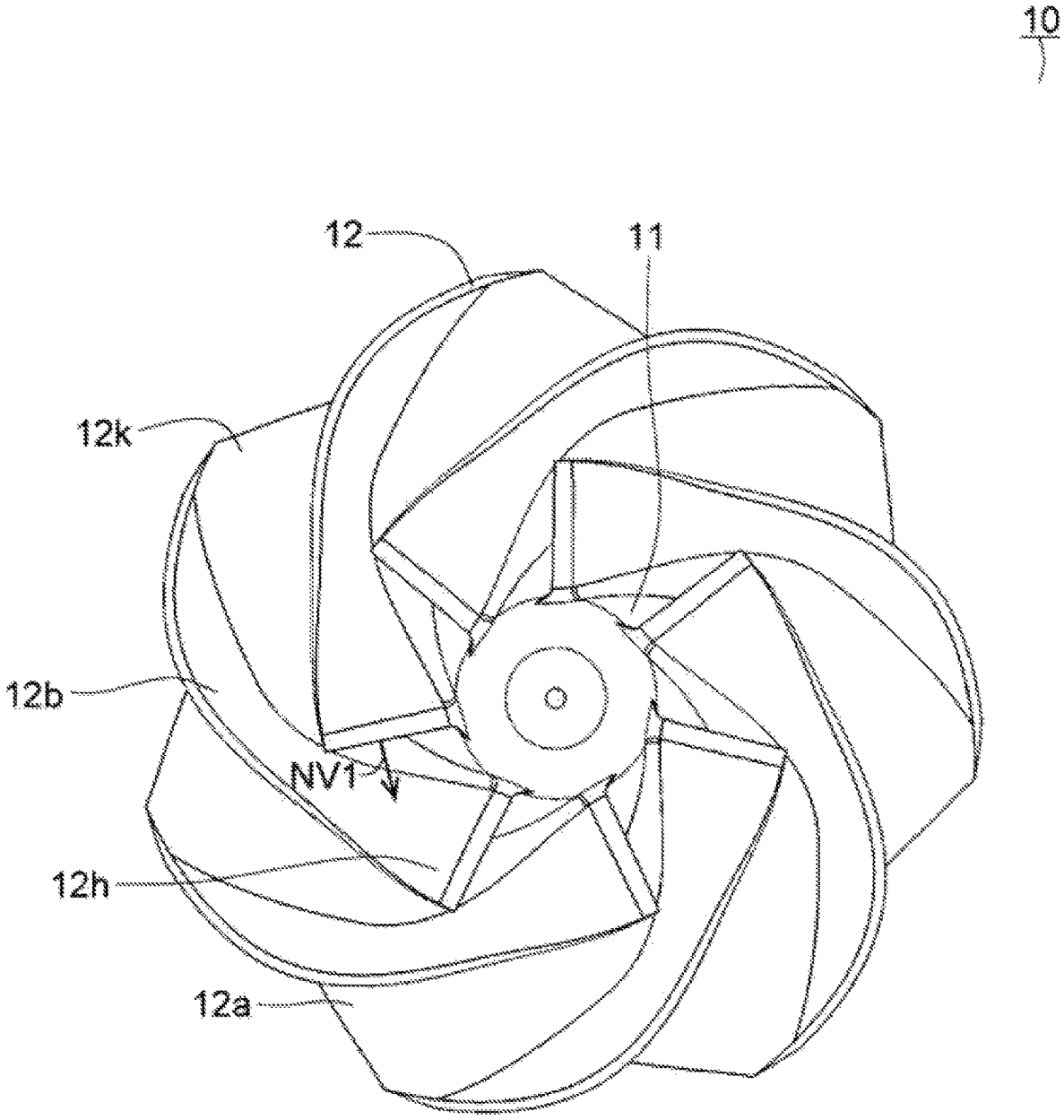
FIG. 8 is a plan view of the impeller.
Figure 9:
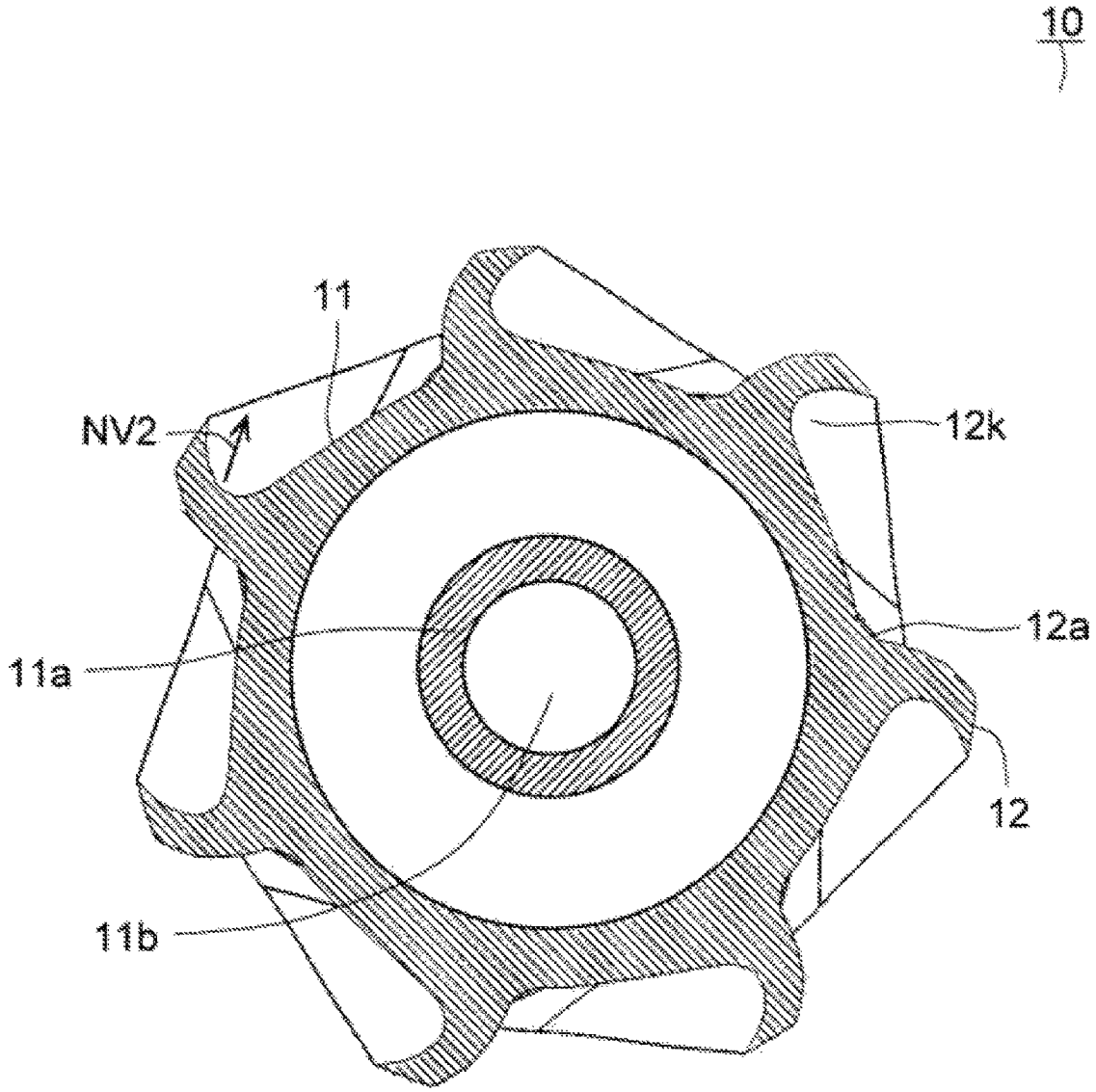
FIG. 9 is a plan sectional view of a cross section passing through a lower end portion of the impeller.
Figure 10:
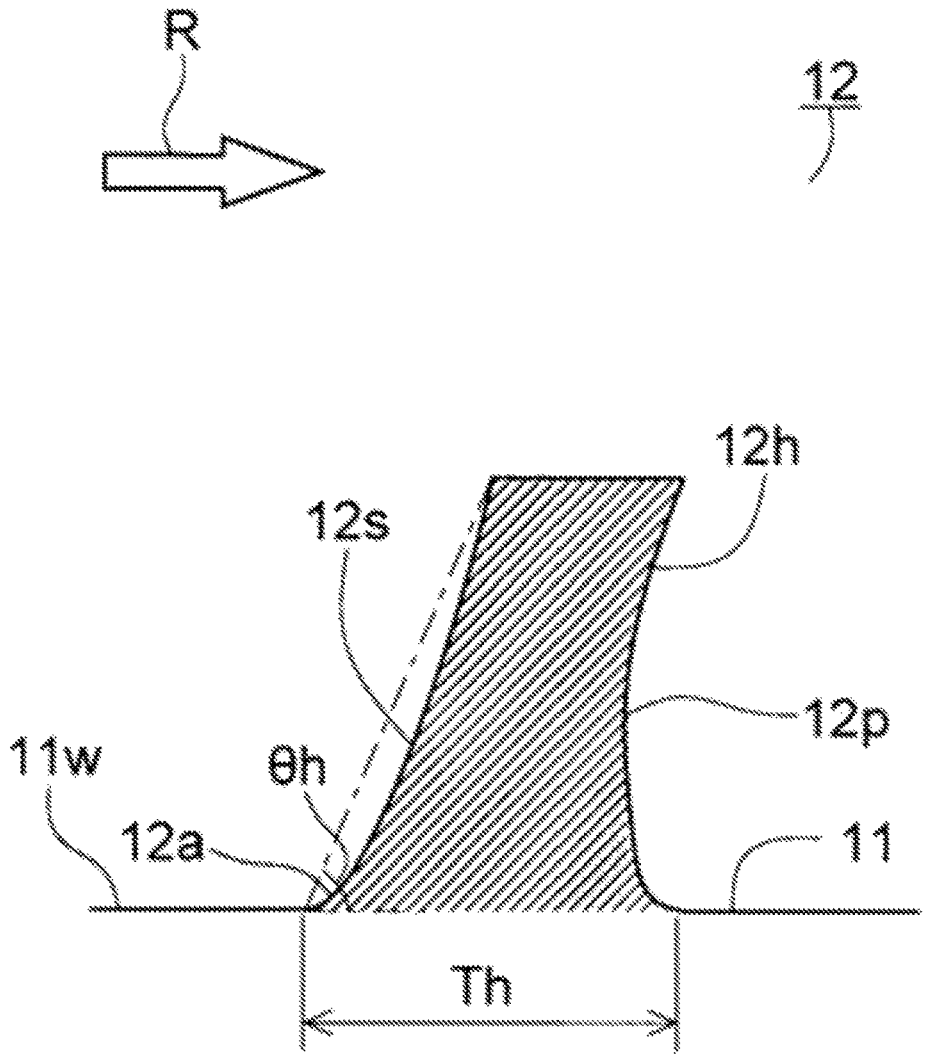
FIG. 10 is a vertical sectional view of an upper end portion of the impeller with respect to the circumferential direction of an outer peripheral surface of a base unit of the impeller.
Figure 11:
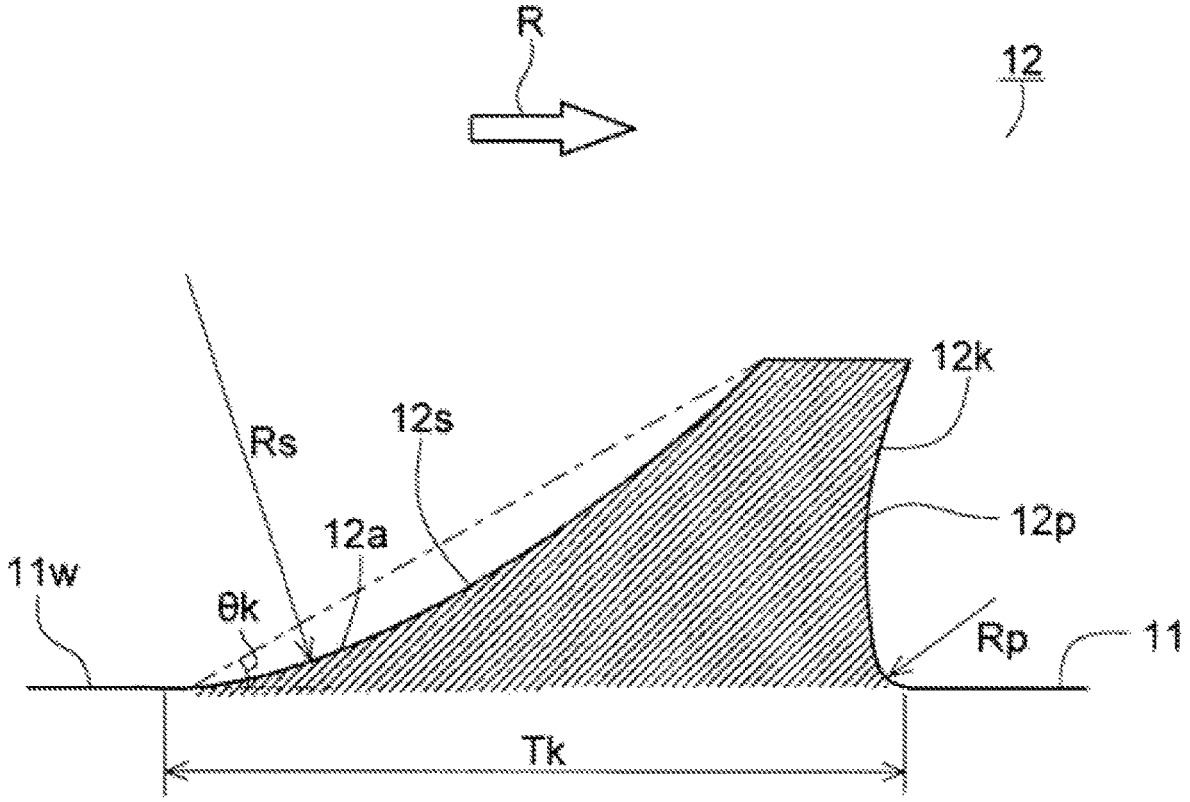
FIG. 11 is a vertical sectional view of a lower end portion of the impeller with respect to the circumferential direction of the outer peripheral surface of the base unit.

FIG. 8 is a plan view of the impeller 10. FIG. 9 is a plan sectional view of a cross section passing through the lower end portion 12*k* of the blade 12 of the impeller 10. FIG. 10 is a vertical sectional view of the upper end portion 12*h* of the blade 12 of the impeller 10 with respect to the circumferential direction of the outer peripheral surface 11*w* of the base unit 11. FIG. 11 is a vertical sectional view of the lower end portion 12*k* of the blade 12 of the impeller 10 with respect to the circumferential direction of the outer peripheral surface 11*w* of the base unit 11. The thickness Tk of the root 12*a* of the lower end portion 12*k* is larger than the thickness Th of the root 12*a* of the upper end portion 12*h*.

The impeller 10 includes the base unit 11 which is enlarged toward a downward direction and the plural blades 12 disposed on the outer peripheral surface 11*w* of the base unit 11. The upper portions of the blades 12 are positioned at the leading end of the rotating direction R with respect to the lower portions of the blades 12. The thickness Tk of the root 12*a* of the lower end portion 12*k* is larger than the thickness Th of the root 12*a* of the upper end portion 12*h*.

A lower edge 12*u* (see FIG. 3) of the blade 12 extends from the root 12*a* upward and outward in the radial direction. That is, the lower edge 12*u* of the blade 12 tilts upward on the outer peripheral surface of the blade 12.

Figure 12:
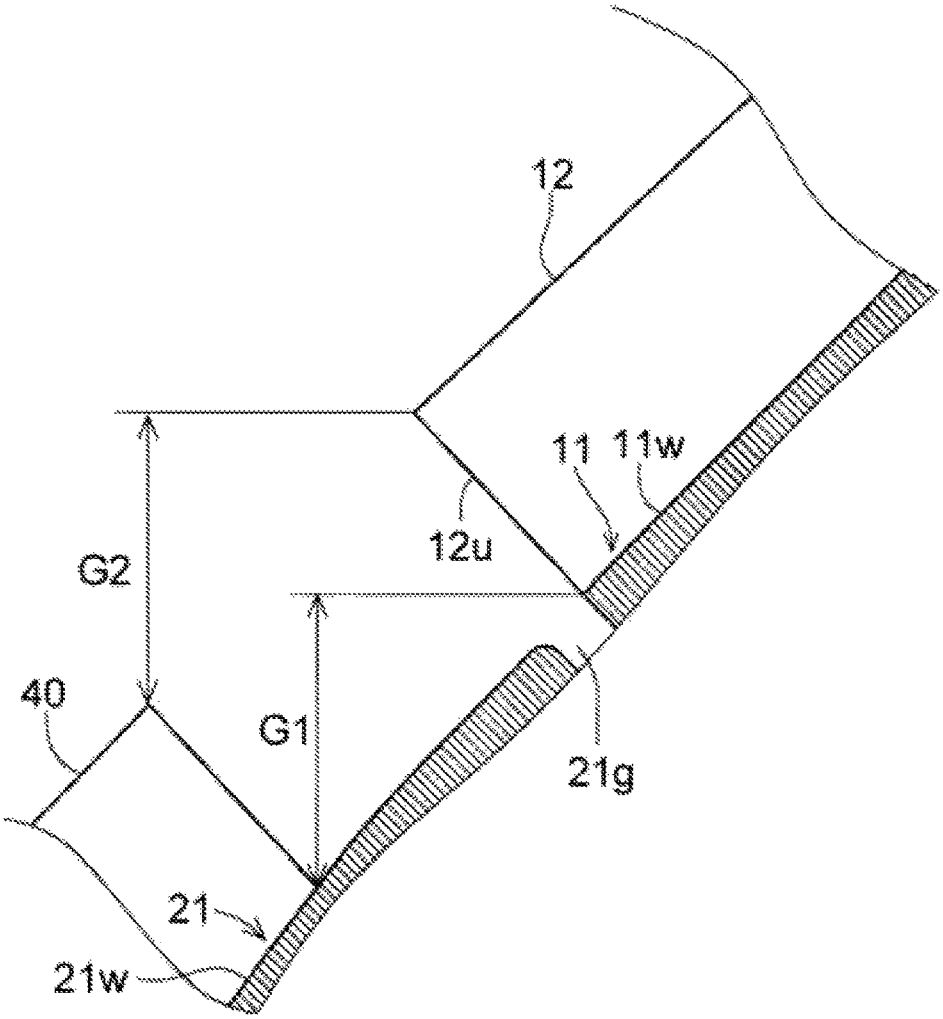
FIG. 12 is a side sectional view for explaining the relationship between a blade and a stationary blade of the fan device.

As shown in FIG. 12, an axial-direction gap G1 between the inner end of the lower edge 12*u* of the blade 12 and an inner end of the upper edge of the stationary blade 40 is equal to an axial-direction gap G2 between the outer end of the lower edge 12*u* of the blade 12 and the outer end of the upper edge of the stationary blade 40. With this configuration, the gap between the blade 12 and the stationary blade 40 is substantially uniform in the radial direction. The circumferential-direction distance between the inner end and the outer end of the lower edge 12*u* of the blade 12 is equal to that between the inner end and the outer end of the upper edge of the stationary blade 40. "Being equal" includes the meaning "being substantially equal", as well as the meaning "being exactly equal".

At the lower end portion 12*k* of the blade 12, the radius of curvature Rs (see FIG. 11) of the root 12*a* on a suction surface 12*s* at the trailing end of the rotating direction R is greater than the radius of curvature Rp (see FIG. 11) of the root 12*a* on the front surface 12*p* (pressure surface) at the leading end of the rotating direction R.

On the suction surface 12*s* of the blade 12, the circumferential-direction tilt angle θh (see FIG. 10) of the upper end portion 12*h* of the blade 12 with respect to the outer peripheral surface 11*w* of the base unit 11 is greater than the circumferential-direction tilt angle θk (see FIG. 11) of the lower end portion 12*k* of the blade 12 with respect to the outer peripheral surface 11*w* of the base unit 11.

Figure 13:
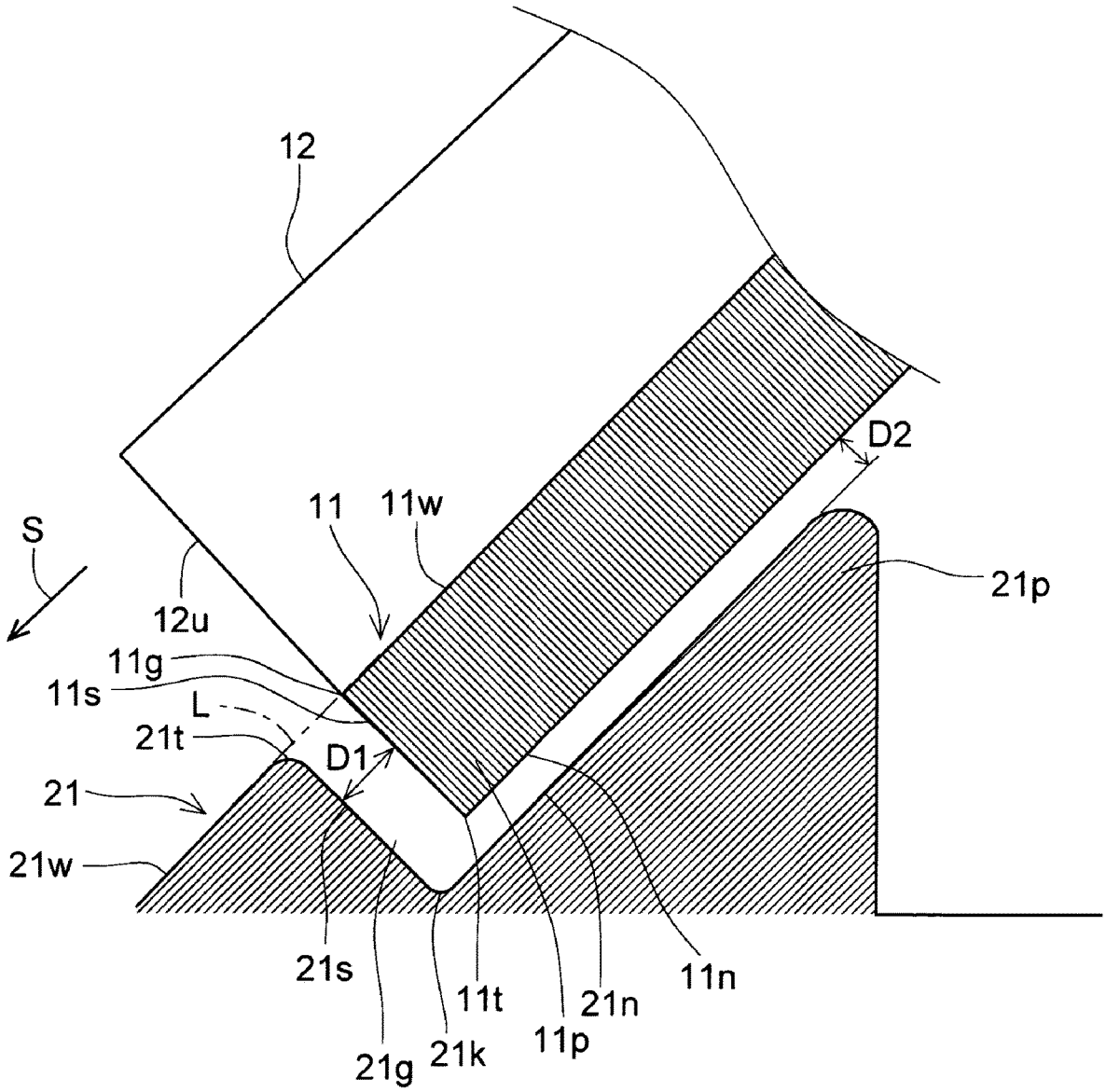
FIG. 13 is an enlarged sectional view of a radial-direction cross section (including the central axis) at peripheral portions of the impeller and a motor housing of the fan device.

FIG. 13 is an enlarged sectional view of a radial-direction cross section (including the central axis C) at the peripheral portions of the motor housing 21 and the impeller 10. The impeller projection 11*p* and the groove 21*g* of the motor housing 21 oppose each other in the axial direction. The upper edge of the groove 21*g* is positioned farther upward than a lower end 11*t* of the impeller projection 11*p*. An outer peripheral end 21*t* of the top surface of the motor housing 21 is the upper edge of the groove 21*g* on the outer side in the radial direction and is positioned farther upward than the lower end 11*t* of the impeller projection 11*p*. A lower end 21*k* of the groove 21*g* is positioned farther downward than the outer peripheral end 21*t* of the top surface of the motor housing 21.

The bottom surface of the base unit 11 (outer peripheral surface 11*s* of the impeller projection 11*p*) extends downward from an outer edge 11*g* as it is directed farther inward in the radial direction. That is, the bottom surface of the base unit 11 tilts downward from the outer edge 11*g*.

The outer peripheral surface 11*s* of the impeller projection 11*p* extends inwards in the radial direction and downward from the outer edge 11*g* of the base unit 11. A side wall 21*s* of the groove 21*g* on the outer side in the radial direction extends inward in the radial direction and downward from the upper end (outer peripheral end 21*t*) of the outer peripheral surface 21*w* of the motor housing 21.

The distance D1 indicates a distance of a gap between the side wall 21*s* of the groove 21*g* and the outer peripheral surface 11*s* of the impeller projection 11*p*. The distance D1 on the outer side in the radial direction and the distance D1 on the inner side in the radial direction are the same. "Being the same" includes the meaning "being substantially the same", as well as the meaning "being exactly the same".

An inner peripheral surface 11*n* of the impeller projection 11*p* and a side wall 21*n* of the groove 21*g* on the inner side in the radial direction extend upward and inward in the radial direction. A distance D2 of a gap between the inner peripheral surface 11*n* of the impeller projection 11*p* and the side wall 21*n* of the groove 21*g* is smaller than the above-described distance D1 of the gap between the side wall 21*s* of the groove 21*g* and the outer peripheral surface 11*s* of the impeller projection 11*p*.

A protruding portion 21*p* protruding upward is formed on the top surface of the motor housing 21, and the outer peripheral surface of the protruding portion 21*p* forms the side wall 21*n* of the groove 21*g* on the inner side in the radial direction. The upper end of the protruding portion 21*p* is positioned farther upward than the lower end 11*t* of the impeller projection 11*p*. The upper end of the protruding portion 21*p* is positioned farther upward than the upper end of the outer peripheral surface 21*w* (outer peripheral end 21*t* of the top surface) of the motor housing 21.

On a cross section including the central axis C, the outer peripheral surface 11*w* of the base unit 11 and the outer peripheral surface 21*w* of the motor housing 21 are positioned on a straight line or a smooth curve indicated by the long dashed dotted line L in the vicinity of the groove 21*g*.

The side wall 21*s* of the groove 21*g* on the outer side in the radial direction is parallel with a surface of rotation constituted by a conical surface formed by rotating the lower edge 12*u* of the blade 12 around the central axis C (see FIG. 4). This conical surface is perpendicular to the outer peripheral surface 11*w* of the base unit 11 on a vertical cross section including the central axis C and is parallel with the upper edge 40*h* of the stationary blade 40 (see FIG. 3). "Being parallel" includes the meaning "being substantially parallel", as well as the meaning "being exactly parallel". "Being perpendicular" includes the meaning "being substantially perpendicular", as well as the meaning "being exactly perpendicular".

In the vacuum cleaner 100 configured as described above, when the motor 20 of the fan device 1 is driven, the impeller 10 is rotated around the central axis C in the rotating direction R. This causes air including trash such as dust on the floor F to sequentially pass through the suction nozzle 110, the suction tube 107, the suction inlet 103 (see FIG. 1 for these elements), the dust collector, and the filter. The air passing through the filter then enters the fan casing 2 via the suction inlet 3 of the fan device 1. In this case, the flow of air sucked from the suction inlet 3 is adjusted by the bell mouth 31 and is smoothly guided to between the adjacent blades 12, thereby enhancing the suction efficiency of the fan device 1.

The air entered the fan casing 2 flows between the adjacent blades 12 and is accelerated by the rotating impeller 10 toward the downward direction on the outer side in the radial direction. The air is then blown out to farther downward than the impeller 10 as a stream S and flows into the flow passage 5. The air then flows between the stationary blades 40 adjacent to each other in the circumferential direction. The sectional area Sk of the lower end of the flow passage between the adjacent stationary blades 40 is larger than the sectional area Sh of the upper end of the flow passage therebetween. Because of this configuration, the dynamic pressure of the stream S flowing through the flow passage 5 can easily be converted into the static pressure.

The stream S passing through the lower ends of the stationary blades 40 is evacuated to the outside of the fan casing 2 via the evacuate outlet 4. The stream S then flows through the air passage within the casing 102 of the vacuum cleaner 100 and is evacuated to the outside of the casing 102 via the evacuate outlet 104 (see FIG. 1). The vacuum cleaner 100 can clean the floor F in this manner.

While the stream S is flowing through the flow passage 5, it partially flows into the flow passage 6 via the flow inlets 21*a*. The stream S then flows upward and flows into the space JK positioned farther upward than the stator 24. The stream S then flows along the top surface of the stator 24 and then moves down along a gap between the rotor 28 and the teeth 24*t*, for example, and is evacuated from the flow outlets 29*a* of the bottom lid 29. This configuration makes heat generated in the stator 24 less likely to accumulate within the motor housing 21, thereby enhancing the cooling efficiency of the stator 24.

The upper portion of the blade 12 is positioned at the leading end of the rotating direction R with respect to the lower portion. In the outer end portion 12*b* on the front surface 12*p* (pressure surface) positioned at the leading end of the rotating direction R, the radial-direction component of the normal unit vector NV1 of the upper end portion 12*h* is smaller than that of the normal unit vector NV2 of the lower end portion 12*k*, assuming that the outer peripheral side of the blade 12 is the positive direction. This configuration makes it possible to smoothly guide the air sucked from the suction inlet 3 toward the flow passage 5 positioned farther downward than the impeller 10. The thickness Tk of the root 12*a* of the lower end portion 12*k* is larger than the thickness Th of the root 12*a* of the upper end portion 12*h*. This makes it possible to increase the strength of the lower end portion 12*k* of the blade 12 where the pressure is increased by air sent by the rotation of the impeller 10.

The ring-like impeller projection 11*p* is formed on the bottom surface of the base unit 11 of the impeller 10. The ring-like groove 21*g* denting downward is formed on the top surface of the motor housing 21. At least part of the impeller projection 11*p* is housed within the groove 21*g*. It is thus possible to prevent the stream S flowing through the flow passage 5 from entering the inside (space SP shown in FIG. 4) of the impeller 10, as well as to regulate the size of the fan device 1 in the axial direction. That is, the labyrinth seal effect is exhibited, thereby enhancing the fan efficiency of the fan device 1.

Figure 14:
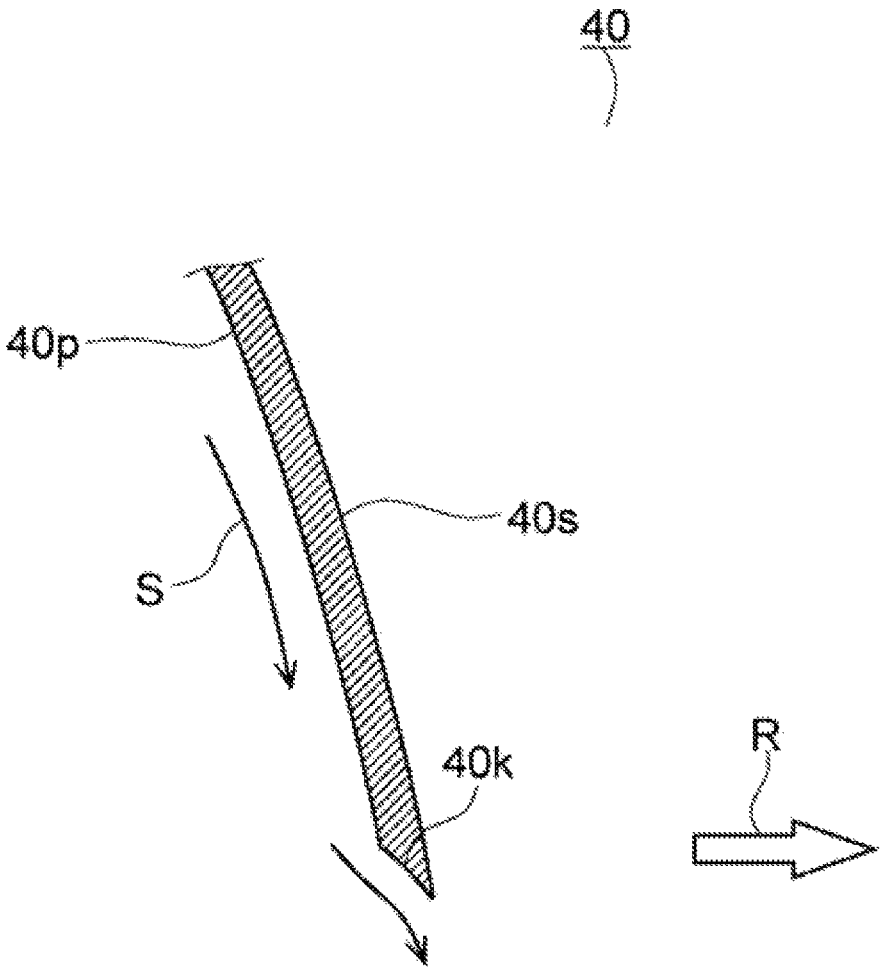
FIG. 14 is an enlarged side sectional view of a stationary blade of a fan device according to a first modified example of the embodiment.

FIG. 14 is an enlarged side sectional view of a stationary blade 40 according to a first modified example of the embodiment. As shown in FIG. 14, a lower end portion 40*k* of a pressure surface 40*p* of the stationary blade 40 may tilt toward the leading end of the rotating direction R of the blade 12 as it is directed farther downward. The pressure surface 40*p* is a surface which the rotating blade 12 approaches. A suction surface 40*s* of the stationary blade 40 is a surface from which the rotating blade 12 separates. The amount of stream S flowing along the pressure surface 40*p* is greater than that of stream S flowing along the suction surface 40*s*. This can decrease the possibility that the stream S flowing along the pressure surface 40*p* will suddenly separate at the lower end portion 40*k* (downstream side) of the stationary blade 40, which accordingly decreases the possibility that the stream S will flow backward.

Figure 15:
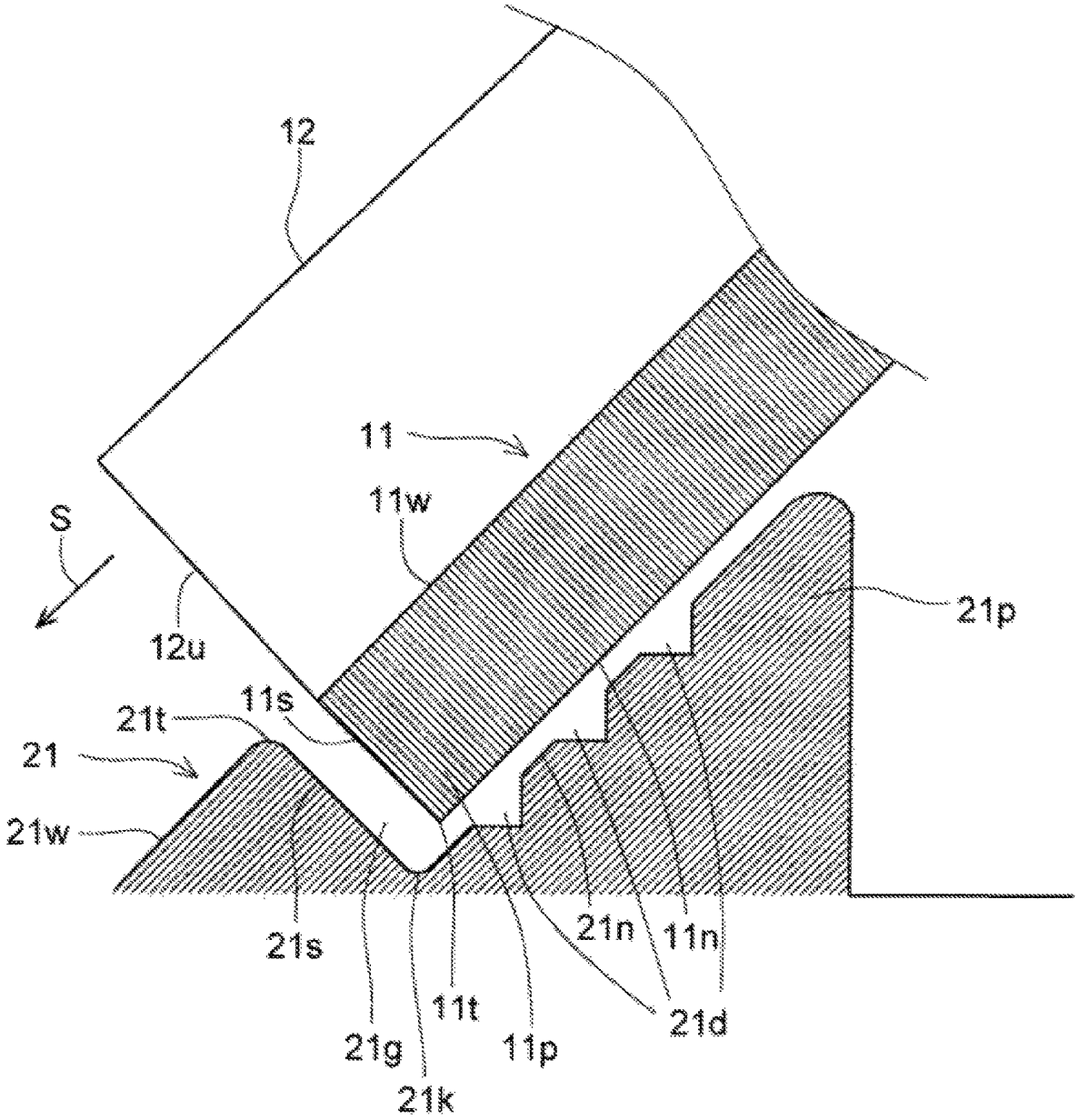
FIG. 15 is an enlarged sectional view of a radial-direction cross section (including the central axis) at peripheral portions of an impeller and a motor housing of a fan device according to a second modified example of the embodiment.

FIG. 15 is an enlarged sectional view of a radial-direction cross section (including the central axis) at peripheral portions of the impeller 10 and the motor housing 21 according to a second modified example of the embodiment. As shown in FIG. 15, plural recesses 21*d* may be formed in the top-bottom direction on the side wall 21*n* on the radial-direction inner side of the groove 21*g*. Air flowing between the inner peripheral surface 11*n* of the impeller projection 11*p* and the side wall 21*n* of the groove 21*g* is more likely to enter the recesses 21*d* when the impeller 10 is rotated. This can decrease the viscosity of air with respect to the impeller 10, thereby enhancing the fan efficiency of the fan device 1.

Figure 16:
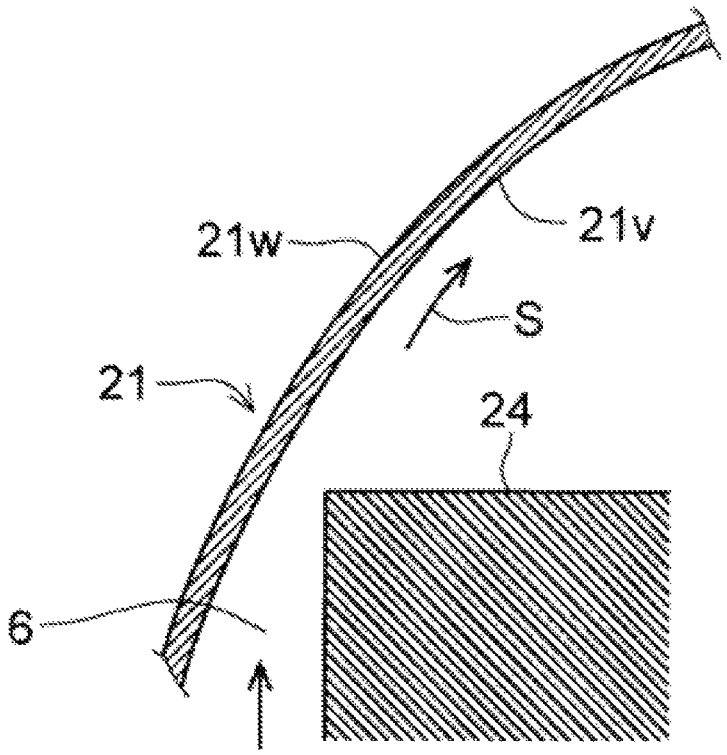
FIG. 16 is an enlarged side sectional view of the upper peripheral portion of a motor housing of a fan device according to a third modified example of the embodiment.

FIG. 16 is an enlarged side sectional view of the upper peripheral portion of the motor housing 21 according to a third modified example of the embodiment. As shown in FIG. 16, an inner surface 21*v* of the motor housing 21 positioned farther upward than the stator 24 may be smoothly curved outward in a convex shape. For example, the inner surface of the motor housing 21 positioned farther upward than the stator 24 may be curved as in the inner surface of a dome.

Figure 17:
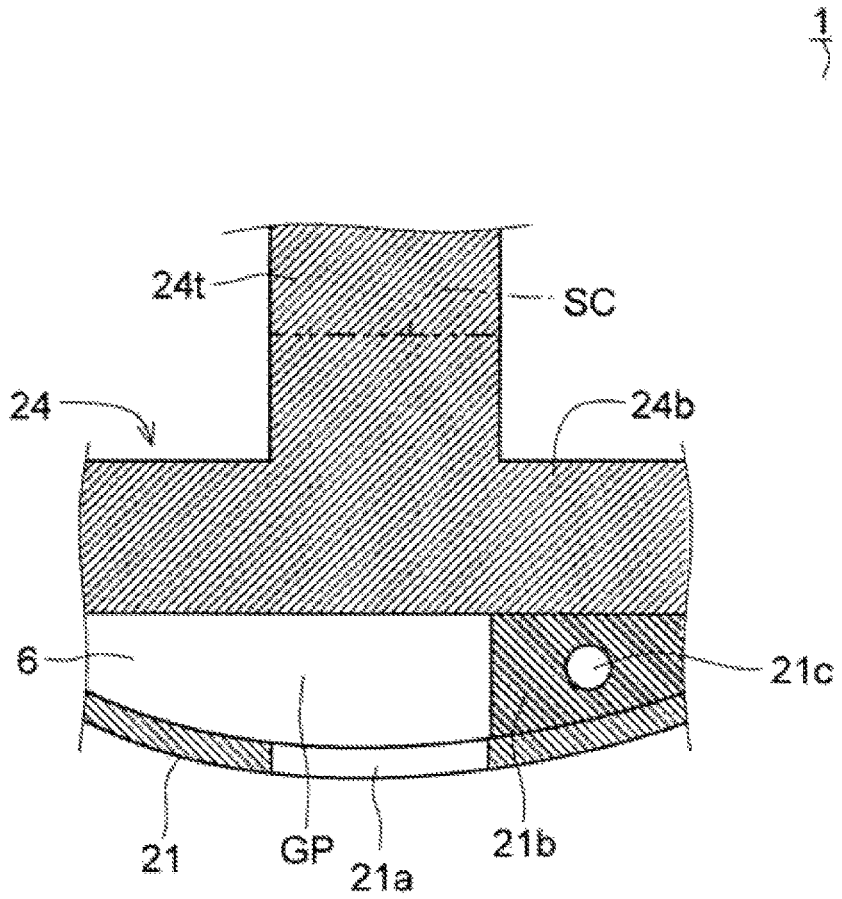
FIG. 17 is an enlarged plan sectional view of the vicinity of a flow inlet of a fan device according to a fourth modified example of the embodiment.

FIG. 17 is an enlarged plan sectional view of the vicinity of the flow inlet 21*a* according to a fourth modified example of the embodiment. As shown in FIG. 17, a cross section SC perpendicular to the radial direction of a tooth 24*t* may oppose a flow inlet 21*a* in the radial direction. This makes it possible to efficiently cool the vicinities of the teeth 24*t* which are likely to become hot. As many flow inlets 21*a* as teeth 24*t* are desirably provided. That is, if flow inlets 21*a* are provided for the teeth 24*t* based on a one-to-one correspondence, the vicinities of the teeth 24*t* which are likely to become hot can efficiently be cooled while the strength of the motor housing 21 is maintained.

In this embodiment, the flow inlets 21*a* are provided in the motor housing 21 farther downward than the top surface of the stator 24 fixed to the inner surface of the motor housing 21. The flow inlets 21*a* pass through the motor housing 21 in the radial direction so as to communicate with the flow passage 5 (first flow passage). The motor housing 21 has the flow passage 6 (second flow passage) which extends from the flow inlets 21*a* upward and which communicates with the space JK formed farther upward than the stator 24. With this configuration, the stream S flowing through the flow passage 5 partially flows into the flow passage 6 via the flow inlets 21*a* and is guided to the space JK, thereby efficiently cooling the stator 24 of the motor 20.

The stator 24 includes the ring-like core back 24*b*. At least part of the core back 24*b* forms the gap GP with the inner surface of the motor housing 21. The flow passage 6 includes the gap GP. It is thus possible to readily form the flow passage 6 while the size of the fan device 1 is regulated.

A cross section perpendicular to the radial direction of the teeth 24*t* may oppose the flow inlets 21*a* in the radial direction. This configuration makes it possible to efficiently cool the vicinities of the teeth 24*t* which are likely to become hot.

As many flow inlets 21*a* as teeth 24*t* are desirably provided. The vicinities of the teeth 24*t* which are likely to become hot can thus be cooled efficiently while the strength of the motor housing 21 is maintained.

The outer surface of the core back 24*b* forms the side surface of the flow passage 6. The vicinities of the core back 24*b* can thus be cooled efficiently.

The inner surface of the motor housing 21 positioned farther upward than the stator 24 tilts farther inward in the radial direction as it is directed farther upward. With this configuration, the stream S can be smoothly guided up to the center of the inside of the motor 20.

The inner surface of the motor housing 21 positioned farther upward than the stator 24 may be smoothly curved outward in a convex shape. For example, the inner surface of the motor housing 21 positioned farther upward than the stator 24 may be curved as in the inner surface of a dome. With this configuration, the stream S can be more smoothly guided up to the center of the inside of the motor 20.

The fan device 1 includes the bottom lid 29 which covers the lower portion of the motor housing 21. The flow outlets 29*a* passing through the bottom lid 29 in the axial direction are provided in the bottom lid 29. With this configuration, the stator 24 can be cooled, and air at increased temperature can easily be evacuated from the flow outlets 29*a*, thereby further enhancing the cooling efficiency of the stator 24.

The plural stationary blades 40 arranged side by side in the circumferential direction are provided on the outer peripheral surface 21*w* of the motor housing 21. The flow inlets 21*a* are provided farther downward than the upper ends of the stationary blades 40. With this configuration, part of the stream S flowing through the flow passage 5 can smoothly flow into the flow passage 6 via the flow inlets 21*a*, thereby further enhancing the cooling efficiency of the stator 24.

The sectional area Sk of the lower end of the flow passage between the stationary blades 40 adjacent to each other in the circumferential direction is larger than the sectional area Sh of the upper end of the flow passage therebetween. This configuration makes it possible to easily convert the dynamic pressure of the stream S flowing through the flow passage 5 into the static pressure and to cause part of the stream S flowing through the flow passage 5 to smoothly flow into the flow passage 6 via the flow inlets 21*a*.

The flow inlets 21*a* may be provided farther downward than the stator 24. The inside of the motor 20 can thus be cooled easily via the stator 24.

The vacuum cleaner 100 includes the above-described fan device 1. It is thus possible to provide a vacuum cleaner in which the cooling efficiency of the stator 24 of the fan device 1 is enhanced.

The impeller 10 includes the base unit 11 which is enlarged toward a downward direction and the plural blades 12 disposed on the outer peripheral surface 11*w* of the base unit 11. The upper portions of the blades 12 are positioned at the leading end of the rotating direction R with respect to the lower portions of the blades 12. In the outer end portion 12*b* on the front surface 12*p* (pressure surface) positioned at the leading end of the rotating direction R, the radial-direction component of the normal unit vector NV1 of the upper end portion 12*h* is smaller than that of the normal unit vector NV2 of the lower end portion 12*k*, assuming that the outer peripheral side of the blade 12 is the positive direction. This configuration makes it possible to smoothly guide the air sucked from the suction inlet 3 toward the flow passage 5 positioned farther downward than the impeller 10. The thickness Tk of the root 12*a* of the lower end portion 12*k* is larger than the thickness Th of the root 12*a* of the upper end portion 12*h*. Pressure applied to the lower end portion 12*k* of the blade 12 is increased by air sent by the rotation of the impeller 10. The above-described configuration makes it possible to increase the strength of the lower end portion 12*k* of the blade 12. When a mold (not shown) placed between the adjacent blades 12 is removed downward and outward in the radial direction to form the impeller 10, the blades 12 are not damaged. The mass productivity of the fan device 1 can thus be improved.

The lower edge 12*u* of the blade 12 extends from the root 12*a* upward and outward in the radial direction. Air flowing between the blades 12 of the impeller 10 can thus be easily guided downward (evacuate side), thereby enhancing the fan efficiency of the fan device 1. The extending direction of the lower edge 12*u* of the blade 12 may not necessarily be parallel with the radial direction nor may it with the axial direction. That is, assuming that the outer side of the radial direction is positive, the extending direction of the lower edge 12*u* of the blade 12 is only required to have a positive radial-direction component. Alternatively, assuming that the upward side of the axial direction is positive, the extending direction of the lower edge 12*u* of the blade 12 is only required to have a positive axial-direction component.

The fan device 1 includes the motor housing 21 which covers the motor 20. The plural stationary blades 40 are provided on the outer peripheral surface 21*w* of the motor housing 21. The upper edge 40*h* of the stationary blade 40 extends farther upward as it is directed outward in the radial direction. With this configuration, air sent from the impeller 10 is caused to flow along the stationary blades 40 without loss, so that the fan efficiency of the fan device 1 can be enhanced.

The lower edge 12*u* of the blade 12 extends upward as it is directed outward in the radial direction. The axial-direction gap G1 between the inner end of the lower edge 12*u* of the blade 12 and the inner end of the upper edge of the stationary blade 40 is equal to the axial-direction gap G2 between the outer end of the lower edge 12*u* of the blade 12 and the outer end of the upper edge of the stationary blade 40. This configuration makes the gap between the blade 12 and the stationary blade 40 substantially uniform in the radial direction. Hence, the pressure distribution within the flow passage 5 becomes uniform, thereby enhancing the fan efficiency of the fan device 1.

The circumferential-direction distance between the inner end and the outer end of the lower edge 12*u* of the blade 12 is equal to that between the inner end and the outer end of the upper edge of the stationary blade 40. This configuration makes the gap in the circumferential direction between the blades 12 and the stationary blades 40 substantially uniform. Hence, the pressure distribution within the flow passage 5 becomes uniform, thereby enhancing the fan efficiency of the fan device 1.

The top-bottom length of the outer end portion 40*g* of the stationary blade 40 is longer than that of the inner end portion 40*n* of the stationary blade 40. Because of this configuration, the stationary blade 40 on the outer peripheral side of the flow passage 5 can be made longer, and thus, air can be guided downward without loss.

The outer end 40*b* of the lower edge of the stationary blade 40 is disposed farther downward than the inner end 40*a*. Because of this configuration, the stationary blade 40 on the outer peripheral side of the flow passage 5 can be made longer, and thus, air can be guided downward without loss.

The lower end portion 40*k* on the pressure surface 40*p* of the stationary blade 40 may tilt toward the leading end of the rotating direction R of the blade 12 as it is directed farther downward. This can decrease the possibility that the stream S flowing along the pressure surface 40*p* (the surface that the blade 12 approaches) will suddenly separate at the lower end portion 40*k* of the stationary blade 40, which accordingly decreases the possibility that the stream S will flow backward.

The bottom surface of the base unit 11 extends downward from the outer edge 11*g* as it is directed farther inward in the radial direction. This configuration makes the thickness of the lower end portion of the base unit 11 of the impeller 10 substantially the same as that of the other portions of the base unit 11, thereby improving the strength of the impeller 10.

The radius of curvature Rs of the root 12*a* on the suction surface 12*s* is greater than the radius of curvature Rp of the root 12*a* on the front surface 12*p* (pressure surface). Hence, the strength of the root 12*a* of the blade 12 can be improved without decreasing the fan efficiency of the fan device 1. With this configuration, a mold placed between the adjacent blades 12 can easily be removed downward and outward in the radial direction without causing interference of the mold with the lower end portion 12*k* of the blade 12.

On the suction surface 12*s* of the blade 12, the circumferential-direction tilt angle θh of the upper end portion 12*h* of the blade 12 with respect to the outer peripheral surface 11*w* of the base unit 11 is greater than the circumferential-direction tilt angle θk of the lower end portion 12*k* of the blade 12 with respect to the outer peripheral surface 11*w* of the base unit 11. With this configuration, a mold placed between the adjacent blades 12 can easily be removed downward and outward in the radial direction without causing interference of the mold with the lower end portion 12*k* of the blade 12.

The ring-like impeller projection 11*p* is formed on the bottom surface of the base unit 11. The ring-like groove 21*g* denting downward is formed on the top surface of the motor housing 21. At least part of the impeller projection 11*p* is housed within the groove 21*g*. It is thus possible to prevent the stream S flowing through the flow passage 5 from entering the inside of the impeller 10, as well as to regulate the size of the fan device 1 in the axial direction. That is, the labyrinth seal effect is exhibited, thereby enhancing the fan efficiency of the fan device 1.

The outer peripheral end 21*t* of the top surface of the motor housing 21 is positioned farther upward than the lower end 11*t* of the impeller projection 11*p*, thereby further enhancing the labyrinth seal effect of the fan device 1.

The lower end 21*k* of the groove 21*g* is positioned farther downward than the outer peripheral end 21*t* of the top surface of the motor housing 21, thereby easily regulating the length of the fan device 1 in the axial direction.

The outer peripheral surface 11*s* of the impeller projection 11*p* extends downward and inward in the radial direction from the outer edge 11*g* of the base unit 11. The side wall 21*s* of the groove 21*g* on the outer side in the radial direction extends downward and inward in the radial direction from the upper end (outer peripheral end 21*t*) of the outer peripheral surface 21*w* of the motor housing 21. This can prevent the contact between the rotating impeller 10 and the side wall 21*s* (inner wall) of the groove 21*g* while exhibiting the labyrinth seal effect.

As described above, the distance D1 indicates a distance of a gap between the side wall 21*s* of the groove 21*g* and the outer peripheral surface 11*s* of the impeller projection 11*p*. The distance D1 on the outer side in the radial direction and the distance D1 on the inner side in the radial direction are the same, thereby enhancing the labyrinth seal effect of the fan device 1.

The inner peripheral surface 11*n* of the impeller projection 11*p* and the side wall 21*n* of the groove 21*g* on the inner side in the radial direction extend upward and inward in the radial direction. The distance D2 of a gap between the inner peripheral surface 11*n* of the impeller projection 11*p* and the side wall 21*n* of the groove 21*g* is smaller than the above-described distance D1 of the gap between the outer peripheral surface 11*s* of the impeller projection 11*p* and the side wall 21*s* of the groove 21*g*. It is thus possible to further enhance the labyrinth seal effect while preventing the contact between the rotating impeller 10 and the side walls 21*s* and 21*n* (inner walls) of the groove 21*g*.

The plural recesses 21*d* may be formed on the side wall 21*n* in the top-bottom direction. Air flowing between the inner peripheral surface 11*n* of the impeller projection 11*p* and the side wall 21*n* of the groove 21*g* is more likely to enter the recesses 21*d* when the impeller 10 is rotated. This can decrease the viscosity of air with respect to the impeller 10, thereby enhancing the fan efficiency of the fan device 1.

The protruding portion 21*p* protruding upward is formed on the top surface of the motor housing 21, and the outer peripheral surface of the protruding portion 21*p* forms the side wall 21*n* of the groove 21*g*. This configuration can further enhance the labyrinth seal effect.

The upper end of the protruding portion 21*p* is positioned farther upward than the lower end 11*t* of the impeller projection 11*p*, thereby even further enhancing the labyrinth seal effect.

The upper end of the protruding portion 21*p* is positioned farther upward than the upper end of the outer peripheral surface 21*w* (outer peripheral end 21*t* of the top surface) of the motor housing 21, thereby further enhancing the labyrinth seal effect.

On a cross section including the central axis C, the outer peripheral surface 11*w* of the base unit 11 and the outer peripheral surface 21*w* of the motor housing 21 are positioned on a straight line or a smooth curve in the vicinity of the groove 21*g*. With this configuration, air can smoothly flow within the flow passage 5 while the groove 21*g* is provided.

The side wall 21*s* of the groove 21*g* on the outer side in the radial direction is parallel with a surface of rotation formed by rotating the lower edge 12*u* of the blade 12 around the central axis C. This configuration makes it possible to prevent the entry of the stream S into the gap between the impeller projection 11*p* and the side wall 21*s* (inner wall) of the groove 21*g*.

On a cross section including the central axis C, a surface of rotation formed by rotating the lower edge 12*u* of the blade 12 around the central axis C is perpendicular to the outer peripheral surface 11*w* of the base unit 11. This configuration makes it possible to prevent the entry of the stream S into the gap between the impeller projection 11*p* and the side wall 21*s* (inner wall) of the groove 21*g*.

The plural stationary blades 40 arranged side by side in the circumferential direction are provided on the outer peripheral surface 21*w* of the motor housing 21. The upper edge 40*h* of the stationary blade 40 is parallel with a surface of rotation formed by rotating the lower edge 12*u* of the blade 12 around the central axis C. With this configuration, air flowing between the adjacent blades 12 can be efficiently sent downward of the flow passage 5 (evacuate side) while preventing the entry of the stream S into the gap between the impeller projection 11*p* and the side wall 21*s* (inner wall) of the groove 21*g*.

The vacuum cleaner 100 includes the above-described fan device 1. It is thus possible to provide a vacuum cleaner including a fan device with improved mass productivity.

The present disclosure is applicable to a fan device and a vacuum cleaner including the same, for example.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan device comprising:

an impeller that rotates around a central axis extending in a top-bottom direction; and a motor that is disposed below the impeller in the top-bottom direction and rotates the impeller, the impeller including a base unit that is enlarged toward a downward direction, and blades that are disposed on a peripheral surface of the base unit, wherein upper portions of the blades are positioned at a leading end of a rotating direction with respect to lower portions of the blades, in an outer end portion on a front surface of each of the blades which is positioned at the leading end of the rotating direction, a radial-direction component of a normal unit vector of an upper end portion of the blade is smaller than a radial-direction component of a normal unit vector of a lower end portion of the blade, assuming that an outer peripheral side of the blade is a positive direction, a thickness of a root of the lower end portion is larger than a thickness of a root of the upper end portion, and portions of radially outermost edges of the blades are positioned radially outward from a radially outermost edge of the base unit along an entirety of the rotating direction.

2. The fan device according to claim 1, wherein a lower edge of each of the blades extends from the root upward and outward in a radial direction.

3. The fan device according to claim 1, further comprising:

a motor housing that covers the motor, a plurality of stationary blades being provided on an outer peripheral surface of the motor housing, wherein an upper edge of each of the stationary blades extends upward as the upper edge is directed farther outward in a radial direction.

4. The fan device according to claim 3, wherein:

a lower edge of each of the blades extends upward as the lower edge is directed outward in the radial direction; and an axial-direction gap between an inner end of the lower edge of the blade and an inner end of an upper edge of the stationary blade is equal to an axial-direction gap between an outer end of the lower edge of the blade and an outer end of the upper edge of the stationary blade.

5. The fan device according to claim 3, wherein a distance between an inner end and an outer end of a lower edge of the blade in a circumferential direction is equal to a distance between an inner end and an outer end of the upper edge of the stationary blade in the circumferential direction.

6. The fan device according to claim 3, wherein a length of an outer end portion of the stationary blade in the top-bottom direction is longer than a length of an inner end portion of the stationary blade in the top-bottom direction.

7. The fan device according to claim 3, wherein an outer end of a lower edge of the stationary blade is disposed farther downward than an inner end of the lower edge of the stationary blade.

8. The fan device according to claim 3, wherein a lower end portion on a pressure surface of the stationary blade tilts toward the leading end of the rotating direction of the blade as the lower end portion is directed farther downward.

9. The fan device according to claim 1, wherein a bottom surface of the base unit extends downward from an outer edge of the base unit as the bottom surface is directed farther inward in the radial direction.

10. The fan device according to claim 1, wherein a radius of curvature of the root on a suction surface of the blade is greater than a radius of curvature of the root on a pressure surface of the blade.

11. The fan device according to claim 1, wherein, on a suction surface of the blade, a tilt angle of the upper end portion of the blade in a circumferential direction with respect to an outer peripheral surface of the base unit is greater than a tilt angle of the lower end portion of the blade in the circumferential direction with respect to the outer peripheral surface of the base unit.

12. A vacuum cleaner comprising:

the fan device according to claim 1.

* * * * *